US009944488B2

(12) United States Patent
Kunieda et al.

(10) Patent No.: US 9,944,488 B2
(45) Date of Patent: Apr. 17, 2018

(54) SHEET PROCESSING APPARATUS AND IMAGE FORMING SYSTEM

(71) Applicants: Akira Kunieda, Tokyo (JP); Nobuyoshi Suzuki, Tokyo (JP); Hidehiko Fujiwara, Tokyo (JP); Katsuhiro Kosuge, Kanagawa (JP); Yuusuke Shibasaki, Kanagawa (JP); Wataru Takahashi, Tokyo (JP); Makoto Hidaka, Tokyo (JP); Shohichi Satoh, Kanagawa (JP); Koki Sakano, Kanagawa (JP); Takuya Morinaga, Tokyo (JP); Yohsuke Haraguchi, Kanagawa (JP); Kota Nakashima, Kanagawa (JP); Shinji Tanoue, Kanagawa (JP); Takahiro Itou, Kanagawa (JP)

(72) Inventors: Akira Kunieda, Tokyo (JP); Nobuyoshi Suzuki, Tokyo (JP); Hidehiko Fujiwara, Tokyo (JP); Katsuhiro Kosuge, Kanagawa (JP); Yuusuke Shibasaki, Kanagawa (JP); Wataru Takahashi, Tokyo (JP); Makoto Hidaka, Tokyo (JP); Shohichi Satoh, Kanagawa (JP); Koki Sakano, Kanagawa (JP); Takuya Morinaga, Tokyo (JP); Yohsuke Haraguchi, Kanagawa (JP); Kota Nakashima, Kanagawa (JP); Shinji Tanoue, Kanagawa (JP); Takahiro Itou, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 146 days.

(21) Appl. No.: 15/153,840

(22) Filed: May 13, 2016

(65) Prior Publication Data

US 2016/0340145 A1 Nov. 24, 2016

(30) Foreign Application Priority Data

May 22, 2015 (JP) ..... 2015-104784

(51) Int. Cl.
*B65H 37/04* (2006.01)
*B31F 1/07* (2006.01)
(Continued)

(52) U.S. Cl.
CPC ..... *B65H 37/04* (2013.01); *B31F 1/07* (2013.01); *B31F 5/02* (2013.01); *B41F 19/02* (2013.01);
(Continued)

(58) Field of Classification Search
CPC ..... B65H 37/04; B65H 2801/27; B31F 1/07; B31F 5/02; B31F 2201/0712;
(Continued)

(56) References Cited

U.S. PATENT DOCUMENTS 6,188,868 B1 * 2/2001 Shiramura ..... G03G 15/6541 347/129
7,413,177 B2 * 8/2008 Mori ..... B65H 39/11 270/58.04
(Continued)

FOREIGN PATENT DOCUMENTS

JP 2012-148505 8/2012
JP 2013-170067 9/2013
JP 2014-105066 6/2014

*Primary Examiner* — Leslie A Nicholson, III
(74) *Attorney, Agent, or Firm* — Harness, Dickey & Pierce, P.L.C.

(57) ABSTRACT

A sheet processing apparatus includes a first binding unit configured to bind a sheet bundle; a second binding unit with greater number of bindable sheets than number of bindable sheets of the first binding unit; and a number-of-sheets determining unit configured to determine whether number of to-be-bound sheets exceeds the number of bindable sheets of
(Continued)

the first binding unit. The first binding unit moves to a binding position, and if the number-of-sheets determining unit determines that the number of to-be-bound sheets exceeds the number of bindable sheets of the first binding unit, the first binding unit moves away from the binding position. When the number-of-sheets determining unit determines that the number of to-be-bound sheets exceeds the number of bindable sheets of the first binding unit, the second binding unit moves to the binding position.

10 Claims, 27 Drawing Sheets

(51) Int. Cl.

| | |
|---|---|
| ***B31F 5/02*** | (2006.01) |
| ***B42F 3/00*** | (2006.01) |
| ***B41F 19/02*** | (2006.01) |
| ***B65H 31/02*** | (2006.01) |
| ***B65H 31/36*** | (2006.01) |
| ***B65H 31/38*** | (2006.01) |

(52) U.S. Cl.
CPC ..... *B42F 3/003* (2013.01); *B65H 31/02* (2013.01); *B65H 31/36* (2013.01); *B65H 31/38* (2013.01); *B31F 2201/0712* (2013.01); *B31F 2201/0761* (2013.01); *B31F 2201/0779* (2013.01); *B65H 2301/4212* (2013.01); *B65H 2301/4213* (2013.01); *B65H 2511/20* (2013.01); *B65H 2511/30* (2013.01); *B65H 2511/414* (2013.01); *B65H 2801/27* (2013.01)

(58) Field of Classification Search
CPC ..... B31F 2201/0779; B31F 2201/0761; B42F 3/003; B41F 19/02
USPC ..... 270/58.08, 58.09
See application file for complete search history.

(56) References Cited

U.S. PATENT DOCUMENTS

| | | | | |
|---|---|---|---|---|
| 8,297,610 | B2 * | 10/2012 | Shiraishi | B65H 37/04 270/58.08 |
| 9,104,163 | B2 * | 8/2015 | Serizawa | B31F 5/02 |
| 9,126,794 | B2 * | 9/2015 | Abe | G03G 15/6541 |
| 2011/0304083 | A1 * | 12/2011 | Strack | B29C 45/14467 264/515 |
| 2013/0214470 | A1 * | 8/2013 | Yokomizo | B65H 37/04 270/1.01 |
| 2014/0077437 | A1 * | 3/2014 | Abe | G03G 15/6541 270/58.12 |
| 2015/0003938 | A1 | 1/2015 | Morinaga et al. | |
| 2015/0021374 | A1 * | 1/2015 | Kubo | B65H 37/04 227/39 |
| 2015/0023765 | A1 * | 1/2015 | Hongu | B65H 43/06 412/33 |
| 2015/0030414 | A1 | 1/2015 | Takahashi et al. | |
| 2015/0076759 | A1 | 3/2015 | Kosuge et al. | |
| 2015/0093214 | A1 | 4/2015 | Takahashi et al. | |

* cited by examiner

SHEET PROCESSING APPARATUS AND IMAGE FORMING SYSTEM

CROSS-REFERENCE TO RELATED APPLICATION

The present application claims priority under 35 U.S.C. § 119 to Japanese Patent Application No. 2015-104784, filed May 22, 2015. The contents of which are incorporated herein by reference in their entirety.

BACKGROUND OF THE INVENTION

1. Field of the Invention

The present invention relates to a sheet processing apparatus and an image forming system.

2. Description of the Related Art

In recent years, there is known a sheet processing apparatus that is connected and used with an image forming apparatus as a part of an image forming system and that binds a plurality of image-formed sheets output by the image forming apparatus.

As the sheet processing apparatus as described above, a sheet processing apparatus has been proposed, which includes a staple binding unit that performs a binding process by a binding method using a staple (hereinafter, referred to as "staple binding") and a stapleless binding unit that performs a binding process by a binding method without using a staple (hereinafter, referred to as "stapleless binding") (for example, see Japanese Unexamined Patent Publication No. 2012-148505).

The sheet processing apparatus configured as described above, upon accepting a binding process execution request, moves a specified binding unit to a binding position without waiting for image formation and output performed by the image forming apparatus to complete. This is done to improve productivity by immediately performing a binding process when all of sheets to be bound are obtained.

Furthermore, in the above-described sheet processing apparatus, an upper limit of the number of sheets that can be bound at one time by the stapleless binding unit (hereinafter, referred to as the "number of bindable sheets") is generally lower than that of the staple binding unit.

Therefore, when a stapleless binding execution request is accepted, and if the specified number of to-be-bound sheets exceeds the number of bindable sheets of the stapleless binding unit, the above-described sheet processing apparatus becomes unable to perform a binding process. Therefore, a sheet processing apparatus has been proposed, which automatically switches from the stapleless binding to the staple binding in the above-described case (for example, see Japanese Unexamined Patent Publication No. 2013-170067).

However, when the above-described sheet processing apparatus switches from the stapleless binding to the staple binding, it is necessary to move the staple binding unit from a home position to a binding position, so that the productivity of the binding process is reduced accordingly.

SUMMARY OF THE INVENTION

According to one aspect of the present invention, there is provided a sheet processing apparatus including: a first binding unit configured to bind a sheet bundle; a second binding unit with greater number of bindable sheets than number of bindable sheets of the first binding unit; and a number-of-sheets determining unit configured to determine whether number of to-be-bound sheets exceeds the number of bindable sheets of the first binding unit, wherein the first binding unit moves to a binding position, and if the number-of-sheets determining unit determines that the number of to-be-bound sheets exceeds the number of bindable sheets of the first binding unit, the first binding unit moves away from the binding position, and when the number-of-sheets determining unit determines that the number of to-be-bound sheets exceeds the number of bindable sheets of the first binding unit, the second binding unit moves to the binding position.

According to another aspect of the present invention, there is provided an image forming system including: an image forming apparatus configured to form an image on a sheet; and a sheet processing apparatus configured to bind a sheet bundle on which images are formed by the image forming apparatus, the sheet processing apparatus including: a first binding unit configured to bind a sheet bundle; a second binding unit with greater number of bindable sheets than number of bindable sheets of the first binding unit; and a number-of-sheets determining unit configured to determine whether number of to-be-bound sheets exceeds the number of bindable sheets of the first binding unit, wherein the first binding unit moves to a binding position, and if the number-of-sheets determining unit determines that the number of to-be-bound sheets exceeds the number of bindable sheets of the first binding unit, the first binding unit moves away from the binding position, and when the number-of-sheets determining unit determines that the number of to-be-bound sheets exceeds the number of bindable sheets of the first binding unit, the second binding unit moves to the binding position.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
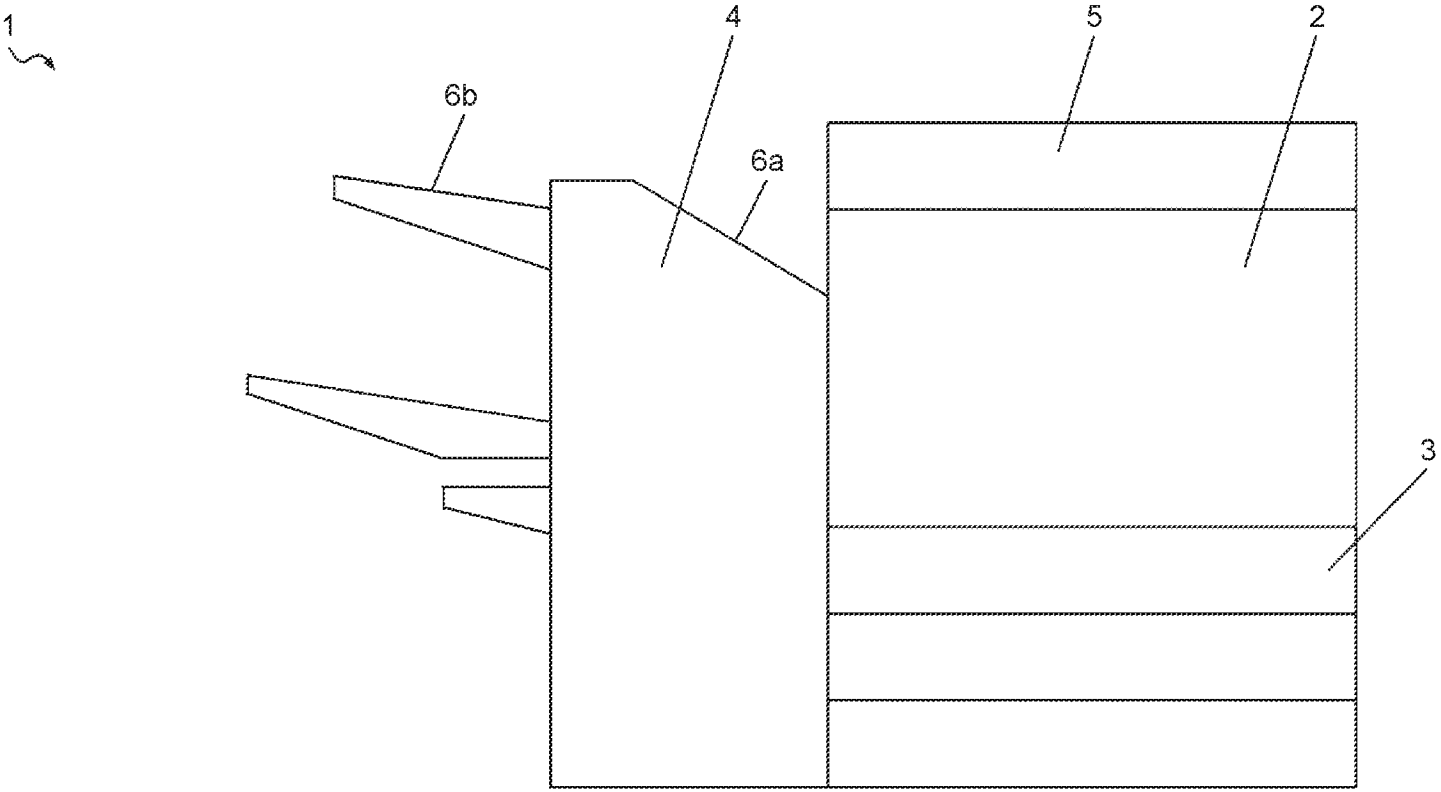
FIG. 1 is a diagram illustrating a simplified overall configuration of an image forming system according to an embodiment of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result. An embodiment of the present invention will be described in detail below with reference to the drawings.

The present invention has an object to improve the productivity of a binding process in a sheet processing apparatus including a plurality of binding units with different number of bindable sheets.

First Embodiment

Exemplary embodiments of the present invention will be described in detail below with reference to the accompanying drawings. First, an overall configuration of an image forming system 1 according to a first embodiment will be described with reference to FIG. 1. FIG. 1 is a diagram illustrating a simplified overall configuration of the image forming system 1 according to the first embodiment. As illustrated in FIG. 1, the image forming system 1 according to the first embodiment includes an image forming apparatus 2, a sheet feeding device 3, a binding processing device 4, and a document reading device 5.

The image forming apparatus 2 forms drawing information on CMYK (Cyan, Magenta, Yellow, and Key Plate) based on input image data, and forms and outputs an image on a sheet fed from the sheet feeding device 3 on the basis of the generated drawing information.

Specific forms of an image forming mechanism in the image forming apparatus 2 according to the first embodiment include an electrophotography system and an inkjet system. A sheet on which an image is formed by the image forming apparatus 2 is conveyed to the binding processing device 4 or discharged and sequentially stacked on a discharge tray 6*a*. The sheet feeding device 3 feeds a sheet to the image forming apparatus 2.

The binding processing device 4 performs a binding process of binding a plurality of image-formed sheets conveyed from the image forming apparatus 2. Furthermore, the binding processing device 4 of the first embodiment includes a staple binding unit that performs a binding process by a binding method using a staple (hereinafter, referred to as "staple binding") and a stapleless binding unit that performs a binding process by a method without using a staple (hereinafter, referred to as "stapleless binding"). That is, in the first embodiment, the binding processing device 4 functions as a sheet processing apparatus. A sheet bundle bound by the binding processing device 4 is discharged and sequentially stacked on a discharge tray 6*b*.

The document reading device 5 digitizes a document by reading the document by a linear image sensor, in which a plurality of photodiodes are arranged in a line and light-receiving elements, such as charge coupled devices (CCDs) or complementary metal oxide semiconductor (CMOS) image sensors, are arranged parallel to the photodiodes. Furthermore, the document reading device 5 may include an automatic document feeder that automatically feeds a document to be read, and may read the document that is automatically fed from the automatic document feeder.

Incidentally, the image forming system 1 according to the first embodiment is a multifunction peripheral (MFP) that includes an imaging function, an image forming function, a communication function, and the like and that can be used as a printer, a facsimile machine, a scanner, and a copier.

Figure 2:
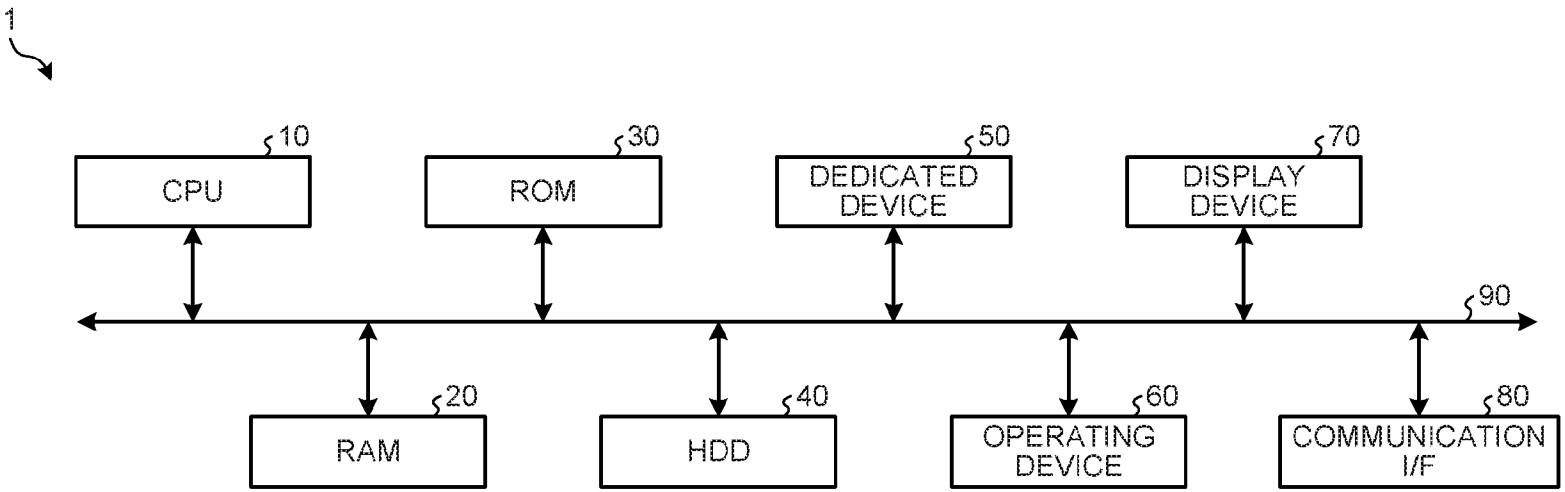
FIG. 2 is a block diagram schematically illustrating a hardware configuration of the image forming system according to the embodiment of the present invention.

A hardware configuration of the image forming system 1 according to the first embodiment will be described below with reference to FIG. 2. FIG. 2 is a block diagram schematically illustrating the hardware configuration of the image forming system 1 according to the first embodiment.

As illustrated in FIG. 2, the image forming system 1 according to the first embodiment includes a central processing unit (CPU) 10, a random access memory (RAM) 20, a read only memory (ROM) 30, a hard disk drive (HDD) 40, a dedicated device 50, an operating device 60, a display device 70, and a communication I/F 80, which are connected to one another via a bus 90.

The CPU 10 is arithmetic means and controls the entire operation of the image forming system 1. The RAM 20 is a volatile storage medium that can read and write information at a high speed, and is used as a work area when the CPU 10 processes information. The ROM 30 is a read-only non-volatile storage medium and stores therein a computer program, such as firmware.

The HDD 40 is a non-volatile storage medium that can read and write information, and stores therein various kinds of data, such as image data, and various programs, such as an operating system (OS), various control programs, and application programs.

The dedicated device 50 is hardware for implementing a function dedicated to the image forming system. That is, the dedicated device 50 is hardware for implementing functions dedicated to a printer, a facsimile machine, a scanner, a copier, and a binding processing mechanism.

The operating device 60 is a user interface for inputting information in the image forming system 1, and implemented by an input device, such as a keyboard, a mouse, an input button, or a touch panel.

The display device 70 is a visual user interface that allows a user to check a state of the image forming system 1, and implemented by a display device, such as a liquid crystal display (LCD), or an output device, such as a light emitting diode (LED).

The communication I/F 80 is an interface that allows the image forming system 1 to communicate with other devices. An interface based on the standard of Ethernet (registered trademark), a universal serial bus (USB) standard, Bluetooth (registered trademark), Wireless Fidelity (Wi-Fi) (registered trademark), FeliCa (registered trademark), peripheral component interconnect express (PCIe), the Institute of Electrical and Electron Engineers (IEEE), or the like may be used.

In the above-described hardware configuration, software control units are constructed by loading a program stored in the storage medium, such as the ROM 30 or the HDD 40, onto the RAM 20, and causing the CPU 10 to perform calculations in accordance with the program loaded on the RAM 20. Functional blocks that implement functions of the image forming system 1 according to the first embodiment are constructed by a combination of hardware and the software control units constructed as above.

Figure 3:
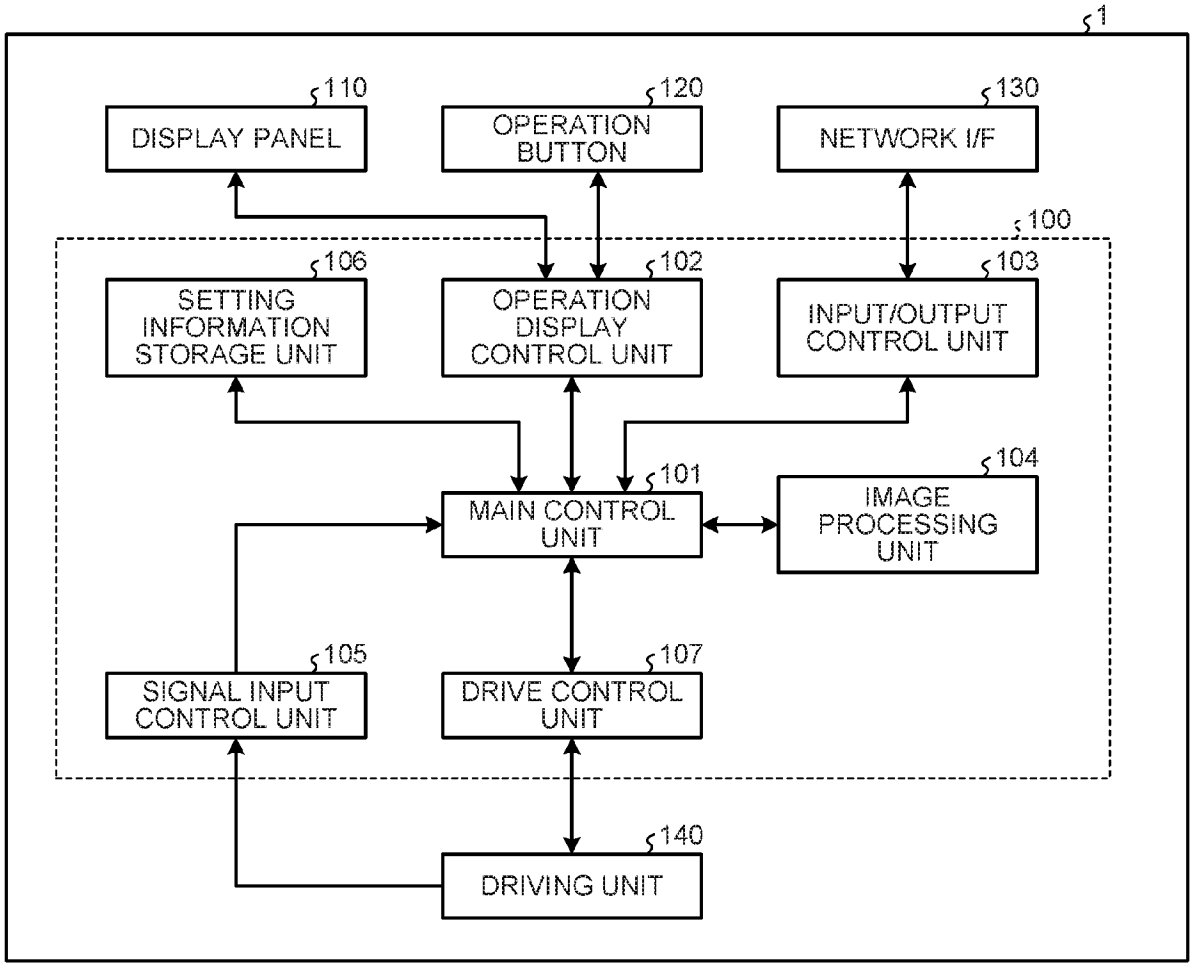
FIG. 3 is a block diagram schematically illustrating a functional configuration of the image forming system according to the embodiment of the present invention.

A functional configuration of the image forming system 1 according to the first embodiment will be described below with reference to FIG. 3. FIG. 3 is a block diagram schematically illustrating the functional configuration of the image forming system 1 according to the first embodiment.

As illustrated in FIG. 3, the image forming system 1 according to the first embodiment includes a controller 100, a display panel 110, an operation button 120, a network I/F 130, and a driving unit 140. The controller 100 includes a main control unit 101, an operation display control unit 102, an input/output control unit 103, an image processing unit 104, a signal input control unit 105, a setting information storage unit 106, and a drive control unit 107.

The display panel 110 serves as an output interface for visually displaying a state of the image forming system, and also serves as an input interface as a touch panel used when a user directly operates the image forming system 1 or when a user inputs information in the image forming system 1. That is, the display panel 110 includes a function to display an image for receiving an operation performed by a user. The display panel 110 is implemented by the operating device 60 and the display device 70 illustrated in FIG. 2.

The operation button 120 is an input interface used when a user directly operates the image forming system 1 or when a user inputs information in the image forming system 1. The operation button 120 is implemented by the operating device 60 illustrated in FIG. 2.

A user can input setting information, such as sheet information, by operating the display panel 110 or the operation button 120.

The network I/F 130 is an interface for communicating with an information processing apparatus, such as a personal computer (PC), operated by a user. The network I/F 130 is implemented by the communication I/F 80 illustrated in FIG. 2. The image forming system 1 receives, via the network I/F 130, the setting information, such as the sheet information, or various kinds of information, such as image data or a print job, sent from the information processing apparatus.

The driving unit 140 is a driving unit, such as a motor or a sensor, that operates in the image forming apparatus 2, the sheet feeding device 3, the binding processing device 4, and the document reading device 5.

The controller 100 is constructed by a combination of software and hardware. That is, the controller 100 is constructed by hardware, such as an integrated circuit, and the software control units that are constructed by causing the CPU 10 to load a program stored in a storage medium, such as the ROM 30 or the HDD 40, onto the RAM 20 and to perform calculations in accordance with the program.

The main control unit 101 functions to control each of the units included in the controller 100, and gives a command to each of the units in the controller 100.

The operation display control unit 102 displays information on the display panel 110 or notifies the main control unit 101 of information input via the display panel 110. The main control unit 101 stores the information notified by the operation display control unit 102 in the setting information storage unit 106 or gives a command to each of the units in the controller 100 in accordance with the information notified by the operation display control unit 102.

The input/output control unit 103 inputs, to the main control unit 101, information that has been input via the network I/F 130. The main control unit 101 stores the information notified by the input/output control unit 103 in the setting information storage unit 106 or gives a command to each of the units in the controller 100 in accordance with the information notified by the input/output control unit 103.

As described above, the main control unit 101 acquires the setting information, such as the sheet information, and various kinds of information, such as image data or a print job, by using the operation display control unit 102 and the input/output control unit 103.

The image processing unit 104 generates, as output information, drawing information on the basis of image information described in the page description language (PDL) or the like, for example, on the basis of document data or image data included in an input print job, under the control of the main control unit 101. The drawing information is information, such as CMYK (cyan, magenta, yellow, and black) bitmap data, and is information used by the image forming system 1 to draw an image to be formed in an image forming operation.

Furthermore, the image processing unit 104 processes captured image data input from the document reading device 5, and generates image data. The image data is information that is stored in the image forming system 1 or transmitted to a different apparatus via the network I/F 130, as an outcome of a scanner operation. Incidentally, the image forming system 1 according to the first embodiment may directly receive drawing information instead of the image information, and may form and output an image based on the directly-input drawing information.

The signal input control unit 105 inputs, to the main control unit 101, a detection signal or a measurement signal input from each of sensors, such as a staple binding unit detection sensor 422, a stapleless binding unit detection sensor 432, and an encoder. The main control unit 101 inputs, to the drive control unit 107, the detection signal or the measurement signal input from the signal input control unit 105.

The setting information storage unit 106 stores therein the setting information, such as the sheet information. The drive control unit 107 controls an operation performed by the driving unit 140.

Figure 4:
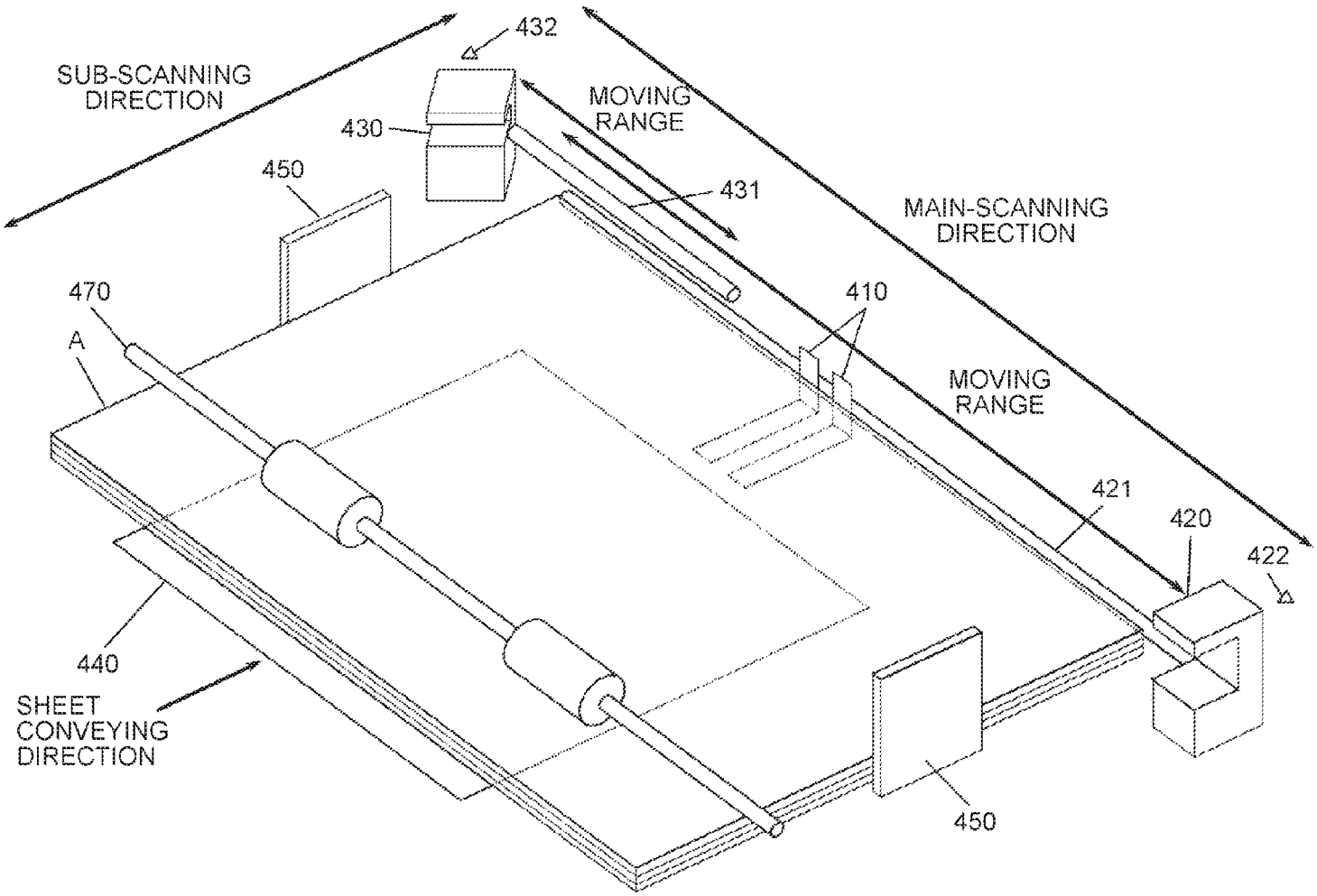
FIG. 4 is a perspective view illustrating an inside of a binding processing device according to the embodiment of the present invention.
Figure 5:
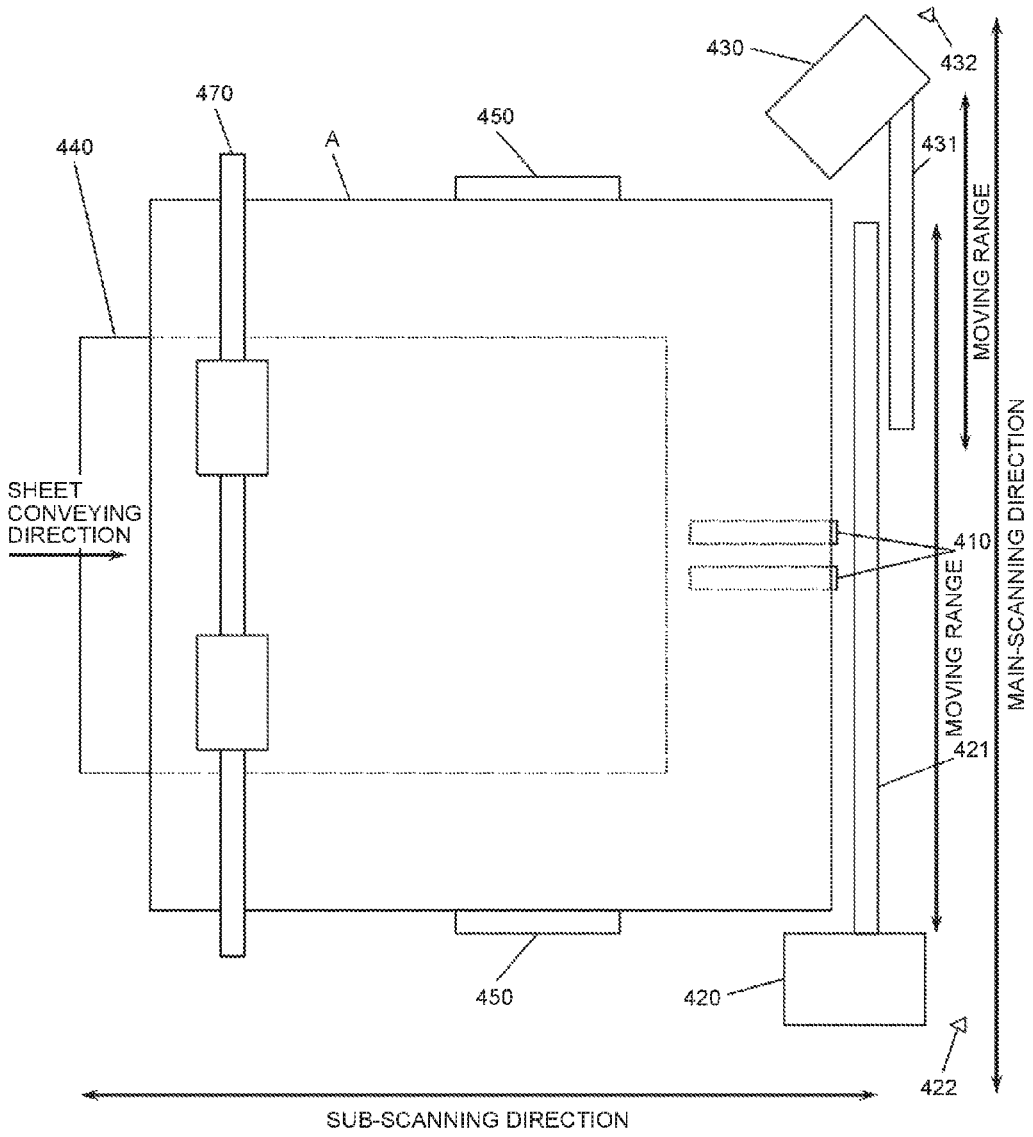
FIG. 5 is a top view illustrating the inside of the binding processing device according to the embodiment of the present invention.
Figure 6:
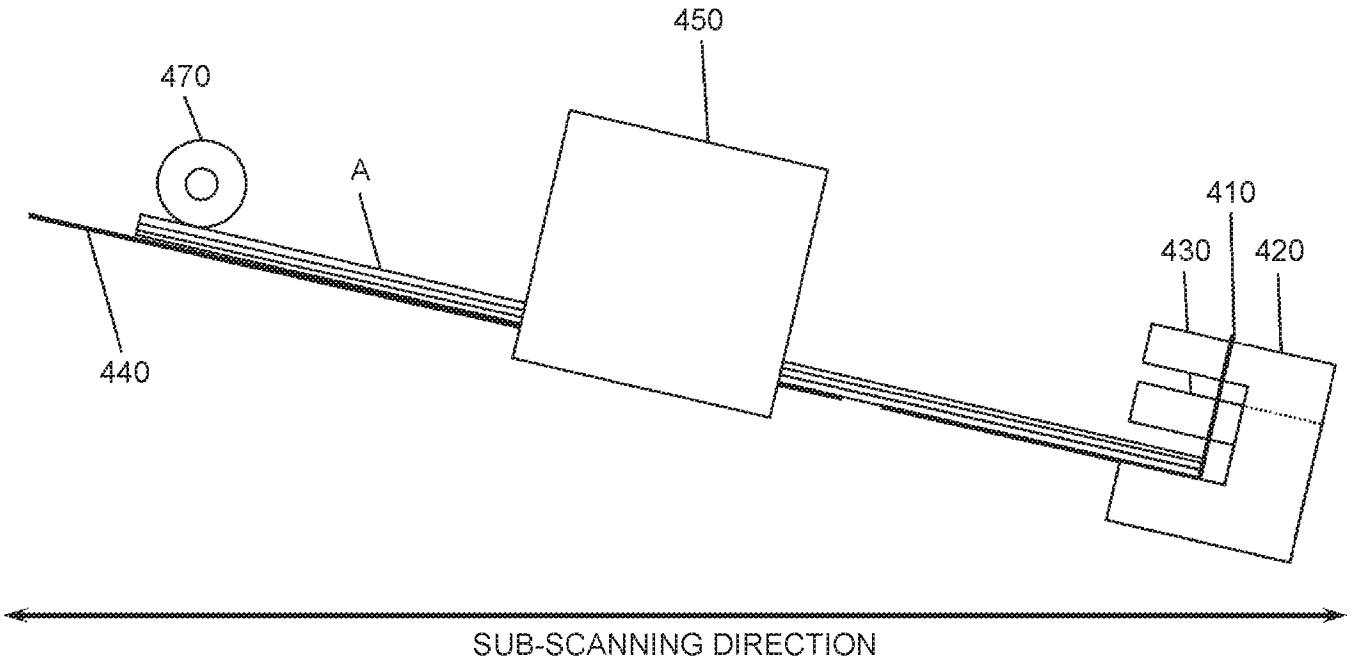
FIG. 6 is a side view illustrating the inside of the binding processing device according to the embodiment of the present invention when viewed in a main-scanning direction.

A configuration of the binding processing device 4 according to the first embodiment will be described below with reference to FIG. 4 to FIG. 6. FIG. 4 is a perspective view illustrating an inside of the binding processing device 4 of the first embodiment. FIG. 5 is a top view illustrating the inside of the binding processing device 4 of the first embodiment. FIG. 6 is a side view illustrating the inside of the binding processing device 4 of the first embodiment when viewed in a main-scanning direction.

As illustrated in FIG. 4 to FIG. 6, the binding processing device 4 of the first embodiment includes rear end alignment stoppers 410, a staple binding unit 420, a staple-binding-unit movement guide rail 421, the staple binding unit detection sensor 422, a stapleless binding unit 430, a stapleless-binding-unit movement guide rail 431, the stapleless binding unit detection sensor 432, a sheet stack plate 440, jogger fences 450, and a conveying roller 470.

Leading ends of sheets stacked on the sheet stack plate 440 in a sheet conveying direction butt against the rear end alignment stoppers 410, so that a sheet bundle A is aligned in the sheet conveying direction.

Figure 7:
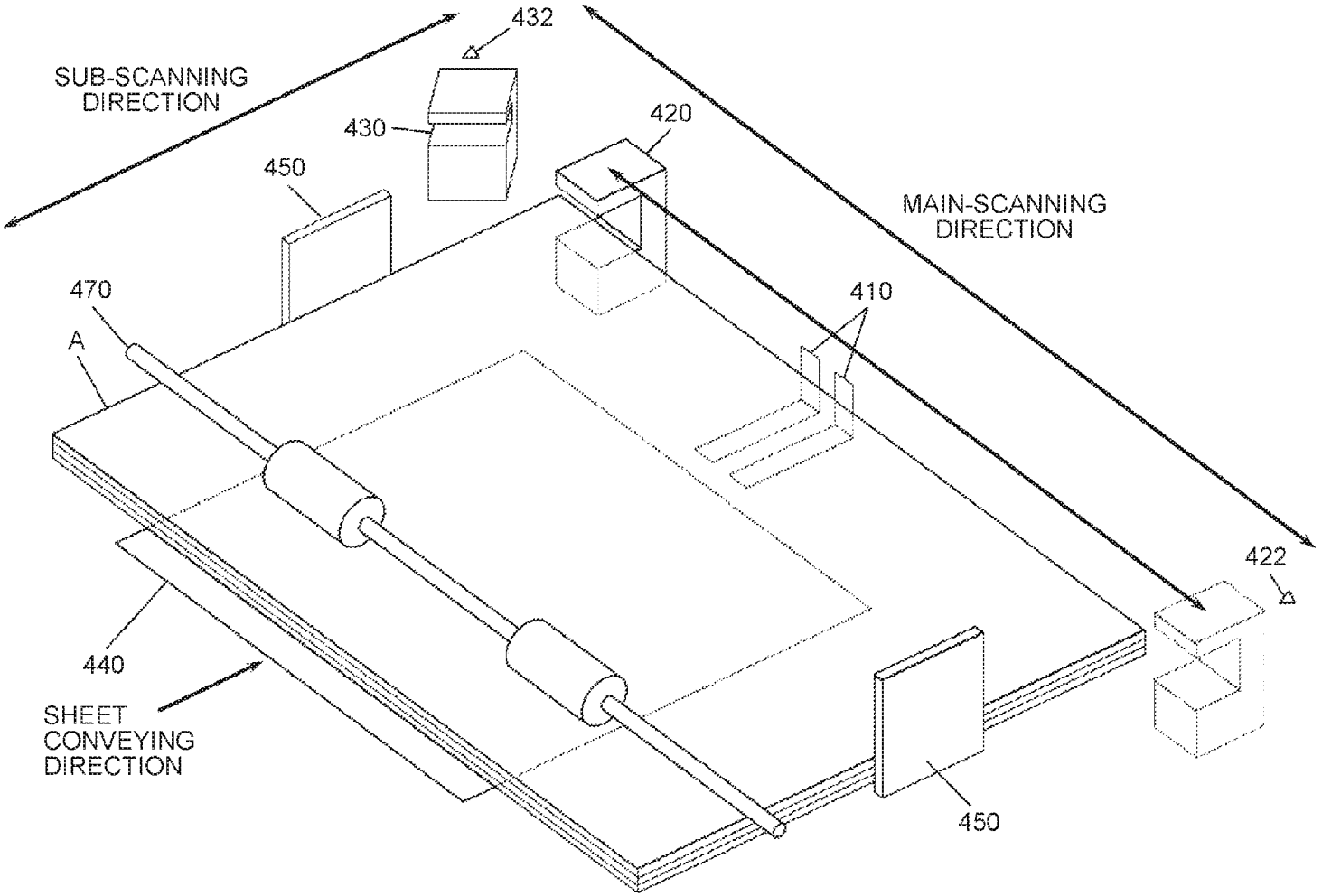
FIG. 7 is a perspective view illustrating the inside of the binding processing device according to the embodiment of the present invention.

The staple binding unit 420 waits in a home position that is a reference position before the binding process. In the binding process stage, as illustrated in FIG. 7, the staple binding unit 420 moves from the home position to a binding position along the staple-binding-unit movement guide rail 421.

Figure 8:
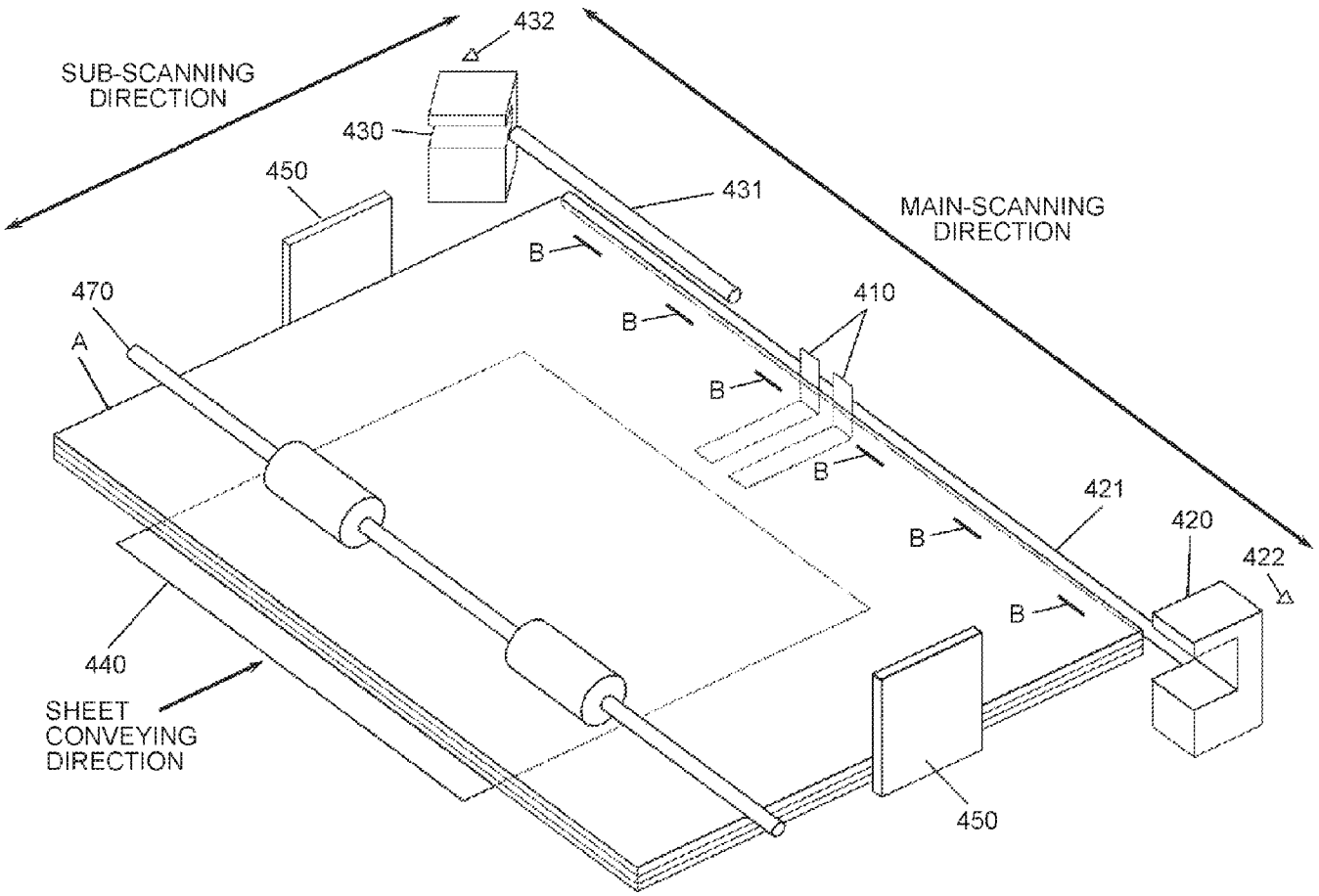
FIG. 8 is a perspective view illustrating the inside of the binding processing device according to the embodiment of the present invention.
Figure 9:
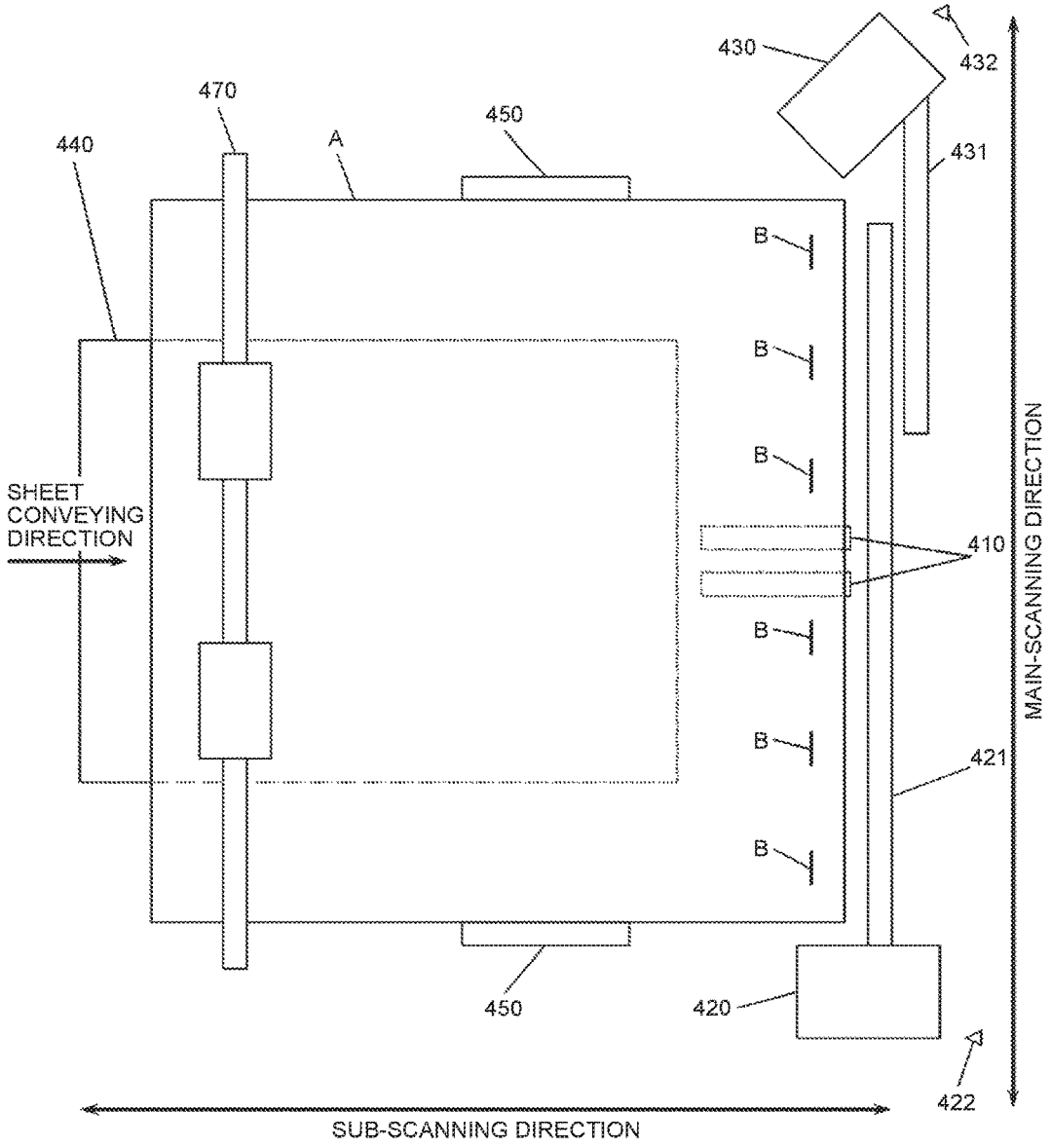
FIG. 9 is a top view illustrating the inside of the binding processing device according to the embodiment of the present invention.
Figure 10:
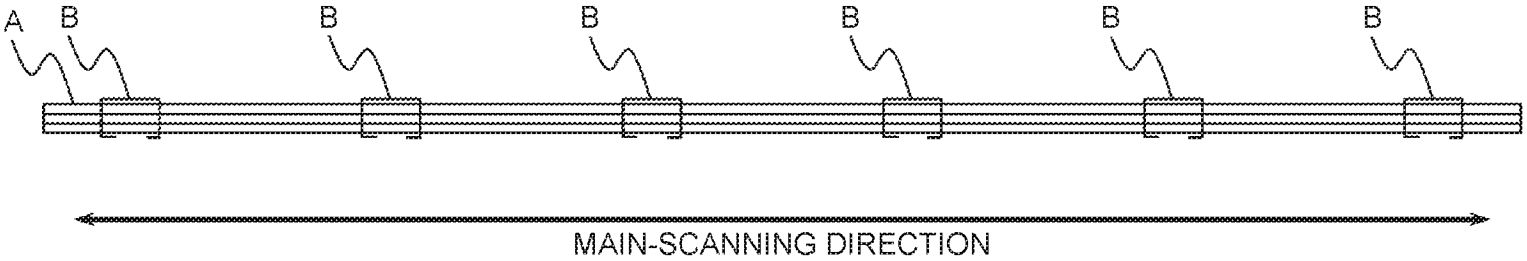
FIG. 10 is a side view of a sheet bundle bound by a staple binding unit according to the embodiment of the present invention when viewed in a sub-scanning direction.

Then, as illustrated in FIG. 8 to FIG. 10, the staple binding unit 420 sandwiches, by binding faces, the sheet surface of the sheet bundle A from above and below at a plurality of binding positions and causes binding staples B to penetrate through the sheet bundle A to thereby bind the sheet bundle A.

Thereafter, upon completing the binding process, the staple binding unit 420 returns to the home position along the staple-binding-unit movement guide rail 421. At this time, the binding processing device 4 detects, by the staple binding unit detection sensor 422, that the staple binding unit 420 waits in the home position or that the staple binding unit 420 has returned to the home position.

Figure 11:
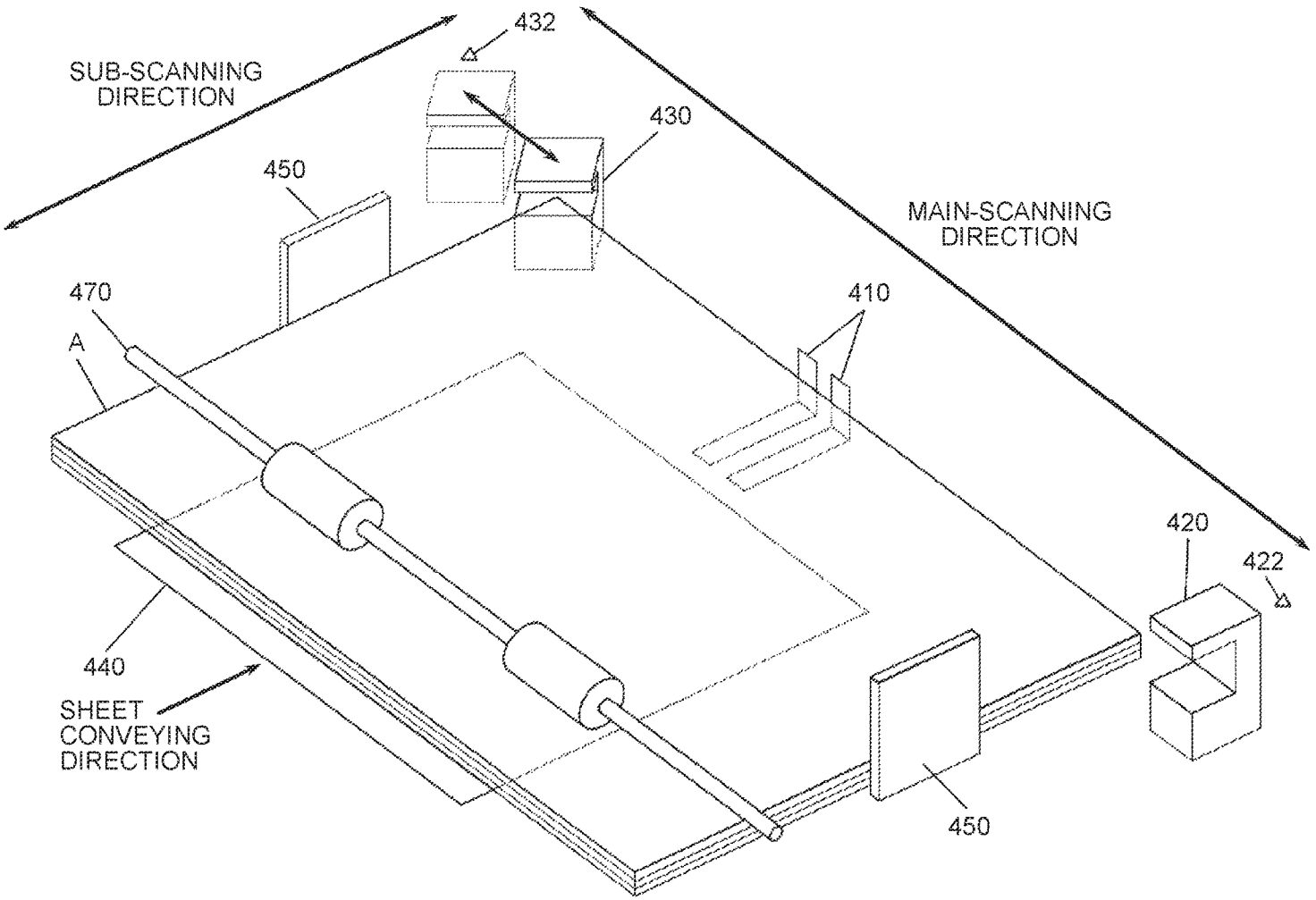
FIG. 11 is a perspective view illustrating the inside of the binding processing device according to the embodiment of the present invention.

The stapleless binding unit 430 waits in a home position that is a reference position before the binding process. In the binding process stage, as illustrated in FIG. 11, the stapleless binding unit 430 moves from the home position to a binding position along the stapleless-binding-unit movement guide rail 431.

Figure 12:
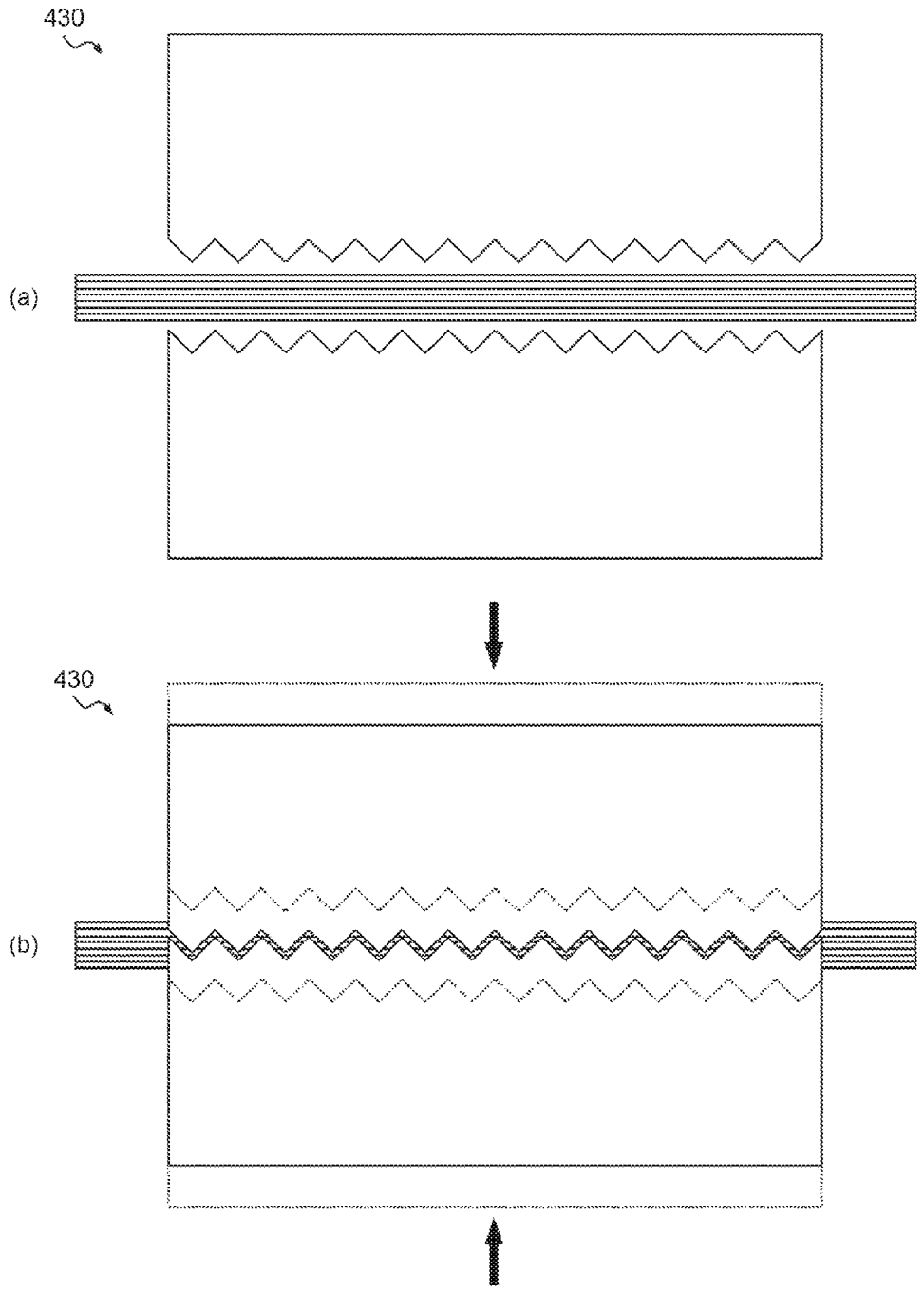
FIG. 12 is a side view of a stapleless binding unit according to the embodiment of the present invention when viewed in the main-scanning direction.
Figure 13:
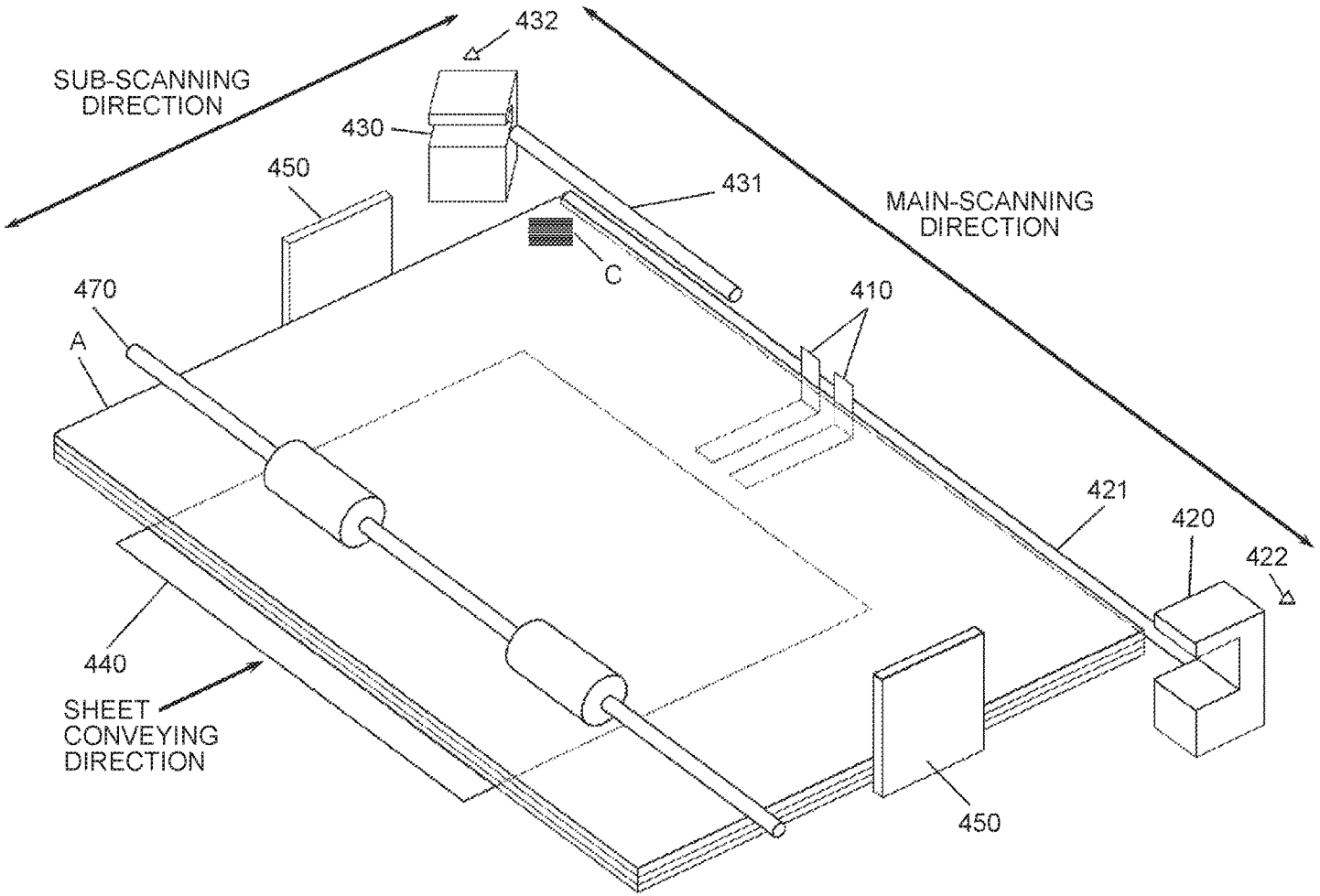
FIG. 13 is a perspective view illustrating the inside of the binding processing device according to the embodiment of the present invention.
Figure 14:
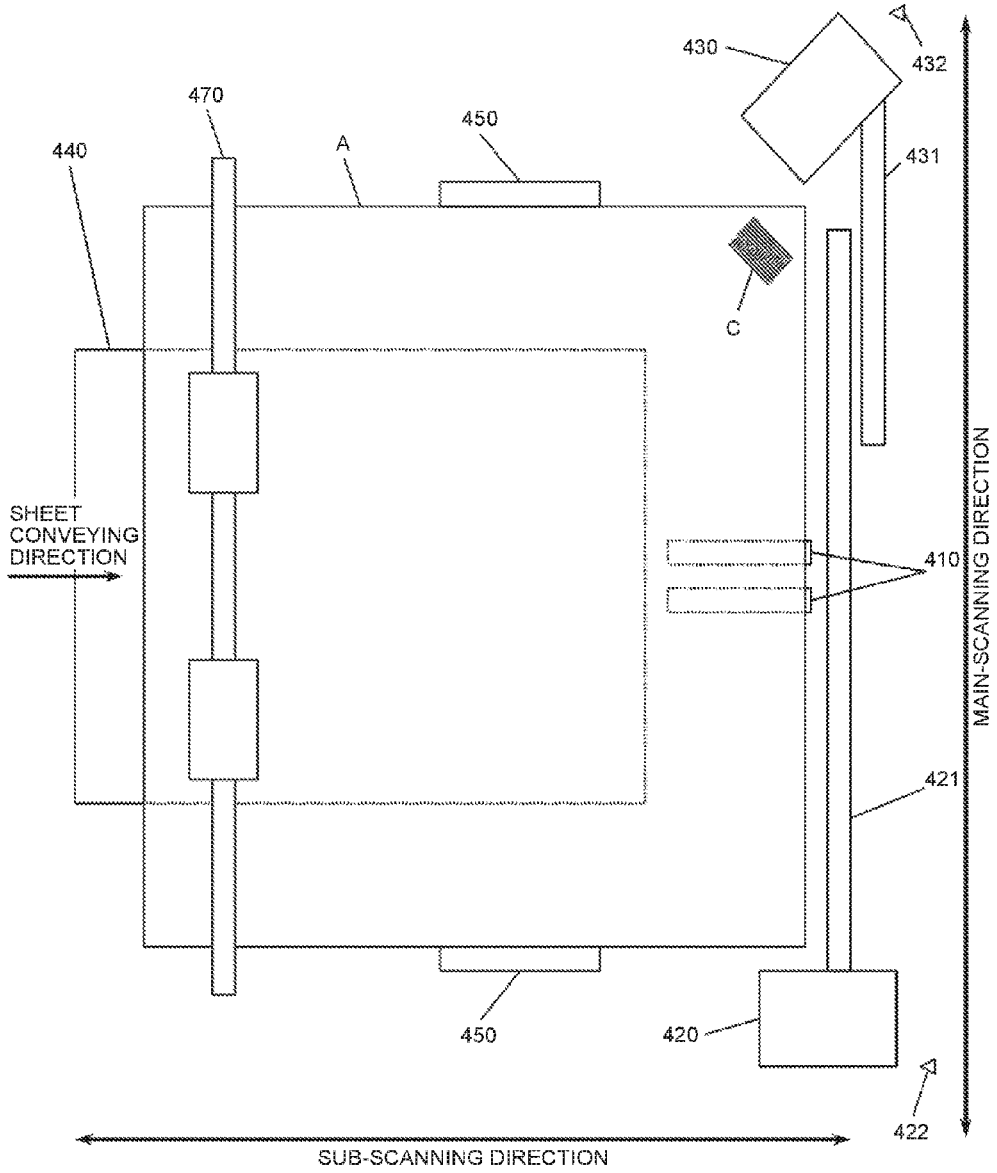
FIG. 14 is a top view illustrating the inside of the binding processing device according to the embodiment of the present invention.
Figure 15:
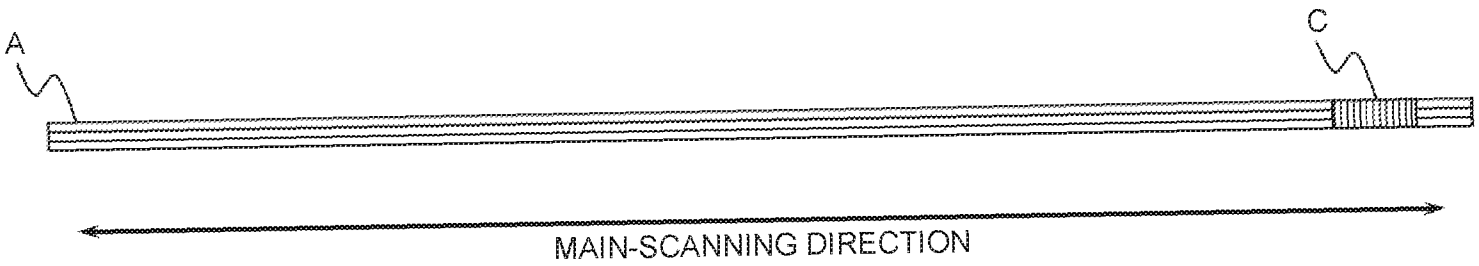
FIG. 15 is a side view of a sheet bundle bound by the stapleless binding unit according to the embodiment of the present invention when viewed in the sub-scanning direction.

Then, as illustrated in FIG. 12(*a*) and FIG. 12(*b*), the stapleless binding unit 430 presses, by binding faces having concave-convex shapes that mesh with each other in a vertical direction, the sheet surface of the sheet bundle A from above and below at a binding position to thereby bind the sheet bundle A. As illustrated in FIG. 13 to FIG. 15, the sheet bundle A pressed as described above is bound at a binding position C such that fibers are intertwined between the sheets.

Thereafter, upon completing the binding process, the stapleless binding unit 430 returns to the home position along the stapleless-binding-unit movement guide rail 431. At this time, the binding processing device 4 detects, by the stapleless binding unit detection sensor 432, that the stapleless binding unit 430 waits in the home position or the stapleless binding unit 430 has returned to the home position.

Figure 16:
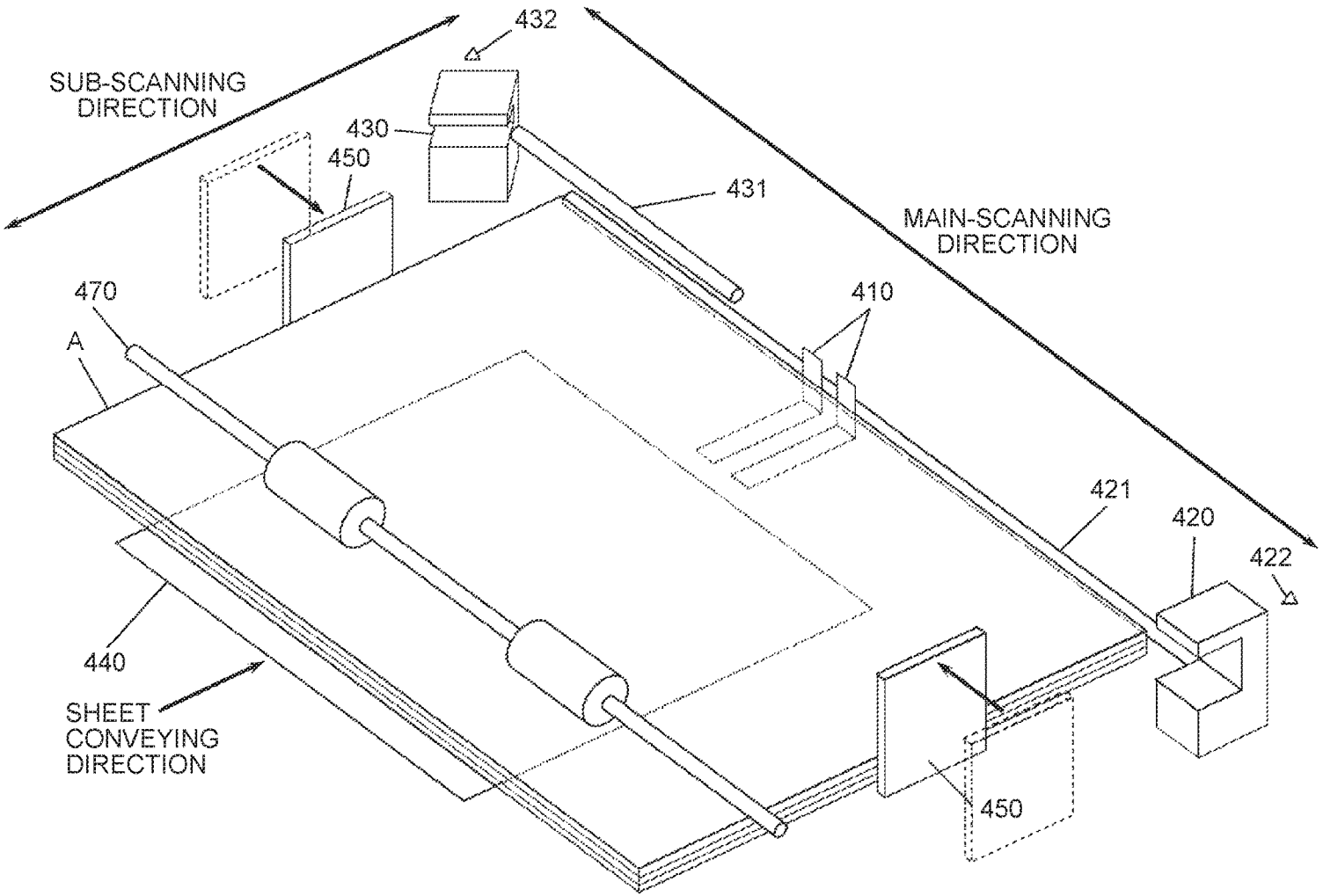
FIG. 16 is a perspective view illustrating the inside of the binding processing device according to the embodiment of the present invention.
Figure 17:
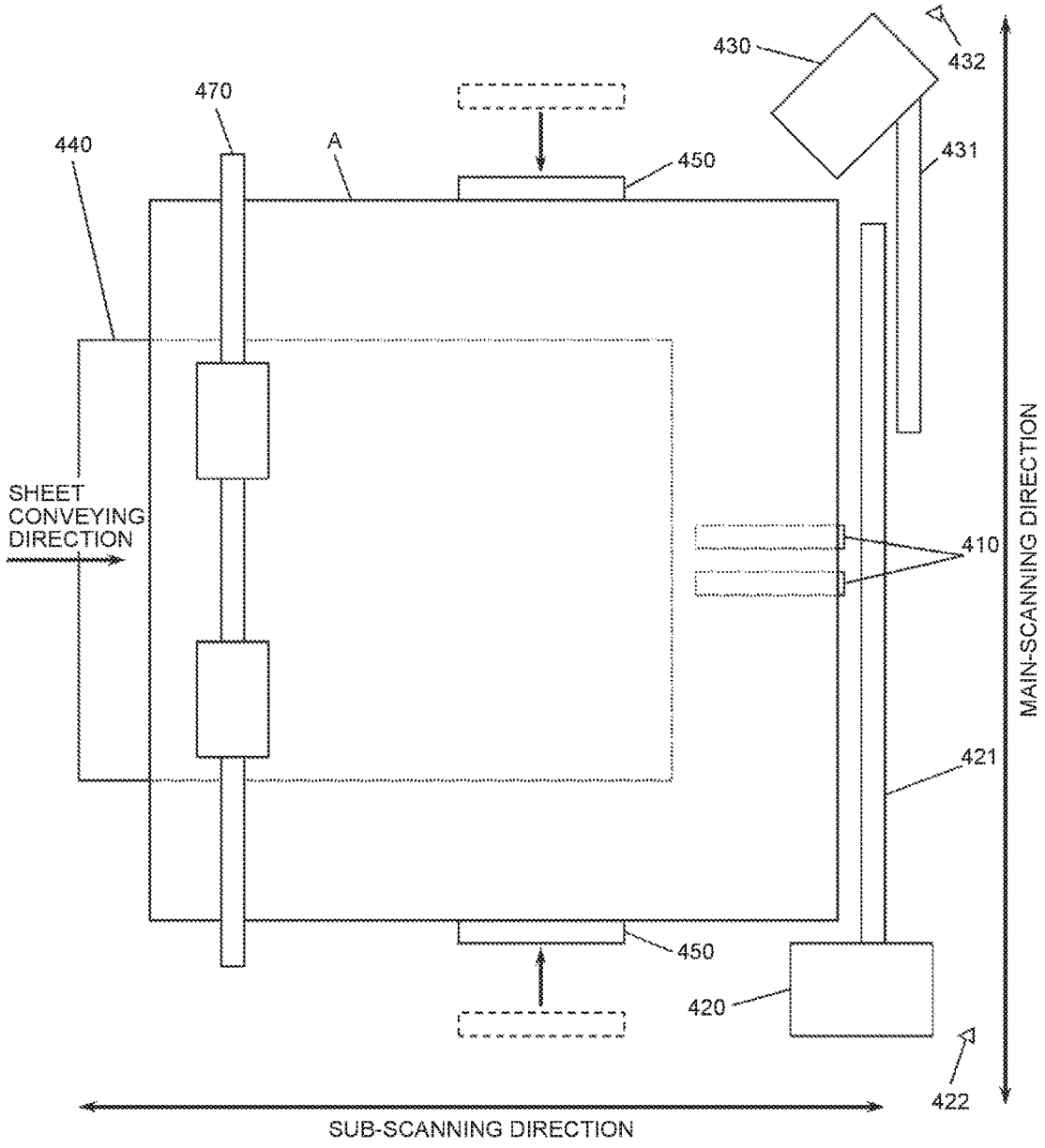
FIG. 17 is a top view illustrating the inside of the binding processing device according to the embodiment of the present invention.

The sheet stack plate 440 stacks sheets until all of sheets of a sheet bundle to be subjected to the binding process are obtained. As illustrated in FIG. 16 and FIG. 17, the jogger fences 450 align the ends of the sheet bundle A in the sheet width direction by coming in press-contact with the both ends of the sheet bundle A in a sheet width direction while moving in facing directions at the both ends of the sheet bundle A stacked on the sheet stack plate 440 in the sheet width direction.

The conveying roller 470 further conveys a sheet that has been conveyed to the sheet stack plate 440 to a downstream side in the sheet conveying direction, and brings a leading end of the sheet in the sheet conveying direction in contact with the rear end alignment stoppers 410. Furthermore, the conveying roller 470 discharges the sheet bundle A subjected to the binding process to the discharge tray 6*b*.

The binding processing device 4 configured as described above is configured to, upon accepting a binding process execution request, move a binding unit corresponding to a specified binding method to the binding position without waiting for image formation and output performed by the image forming apparatus 2 to complete. This is done to improve productivity by immediately performing the binding process when all of sheets to be bound are obtained.

Furthermore, in the binding processing device 4 configured as described above, an upper limit of the number of sheets that can be bound at one time by the stapleless binding unit 430 (hereinafter, referred to as the "number of bindable sheets") is lower than that of the staple binding unit 420.

Therefore, when a stapleless binding execution request is accepted, and if the specified number of to-be-bound sheets exceeds the number of bindable sheets of the stapleless binding unit 430, the binding processing device 4 becomes unable to perform the binding process. Therefore, the binding processing device 4 is configured to automatically switch from the stapleless binding to the staple binding in the above-described case.

However, when the binding processing device 4 switches from the stapleless binding to the staple binding, it is necessary to move the stapleless binding unit 430 away from the binding position and move the staple binding unit 420 from the home position to the binding position.

Therefore, in the binding processing device 4 configured as described above, the productivity of the binding process is reduced accordingly. In particular, if a moving distance of the staple binding unit 420 from the home position to the binding position is increased, the productivity is further reduced.

Therefore, it may be possible to use a method, in which when the stapleless binding execution request is accepted, it is determined whether it is necessary to switch to the staple binding without moving the stapleless binding unit 430 to the binding position, and the stapleless binding unit 430 or the staple binding unit 420 is moved to the binding position based on a determination result.

However, in this method, the binding processing device 4 is not allowed to move the stapleless binding unit 430 until the determination result is obtained even when it is not necessary to switch to the staple binding. Therefore, in the above-described binding processing device 4, there may be a case in which the stapleless binding unit 430 does not reach the binding position even when all of sheets to be bound are obtained. Consequently, the productivity of the binding process is reduced accordingly.

Therefore, the binding processing device 4 of the first embodiment is configured to, upon accepting the stapleless binding execution request, move the stapleless binding unit 430 to the binding position and move the staple binding unit 420 to the vicinity of the binding position before a determination result on whether it is necessary to switch to the staple binding is obtained. In the following, an operation mode in which the binding processing device 4 operates to move the staple binding unit 420 as described above every time the stapleless binding execution request is accepted will be referred to as a "productivity priority mode".

In the configuration of the binding processing device 4 of the first embodiment as described above, the moving distance of the staple binding unit 420 at the time of switching from the stapleless binding to the staple binding is reduced, so that it is possible to improve the productivity of the binding process.

Incidentally, if the binding processing device 4 of the first embodiment moves the staple binding unit 420 every time the stapleless binding execution request is accepted, power is wasted when the staple binding is not performed.

Therefore, the binding processing device 4 of the first embodiment is configured to move the staple binding unit 420 to the binding position after obtaining a determination result indicating that it is necessary to switch to the staple binding. In the following, an operation mode in which the binding processing device 4 operates to move the staple binding unit 420 to the binding position after obtaining the determination result indicating that it is necessary to switch to the staple binding as described above will be referred to as an "energy-saving priority mode 1".

In the configuration of the binding processing device 4 of the first embodiment as described above, it is possible to reduce power consumption without reducing the productivity.

Furthermore, if the binding processing device 4 of the first embodiment moves the stapleless binding unit 430 every time the stapleless binding execution request is accepted, power is wasted when the stapleless binding is not performed.

Therefore, the binding processing device 4 of the first embodiment is configured to move only the stapleless binding unit 430 to the binding position after obtaining a determination result indicating that it is not necessary to switch to the staple binding. In the following, an operation mode in which the binding processing device 4 operates to move only the stapleless binding unit 430 after obtaining the determination result indicating that it is not necessary to switch to the staple binding as described above will be referred to as an "energy-saving priority mode 2".

In the configuration of the binding processing device 4 of the first embodiment as described above, it is possible to further reduce power consumption as compared to the energy-saving priority mode 1.

Incidentally, these operation modes are selectable through a user operation on the display panel 110 or the operation button 120, or from an external apparatus connected via the network I/F 130, and the main control unit 101 controls transition between the operation modes.

The main control unit 101 in the binding processing device 4 of the first embodiment sets the productivity priority mode at the time of default. That is, in the first embodiment, the main control unit 101 functions as a timing setting unit that sets a timing of moving the staple binding unit to the vicinity of the binding position.

Figure 18:
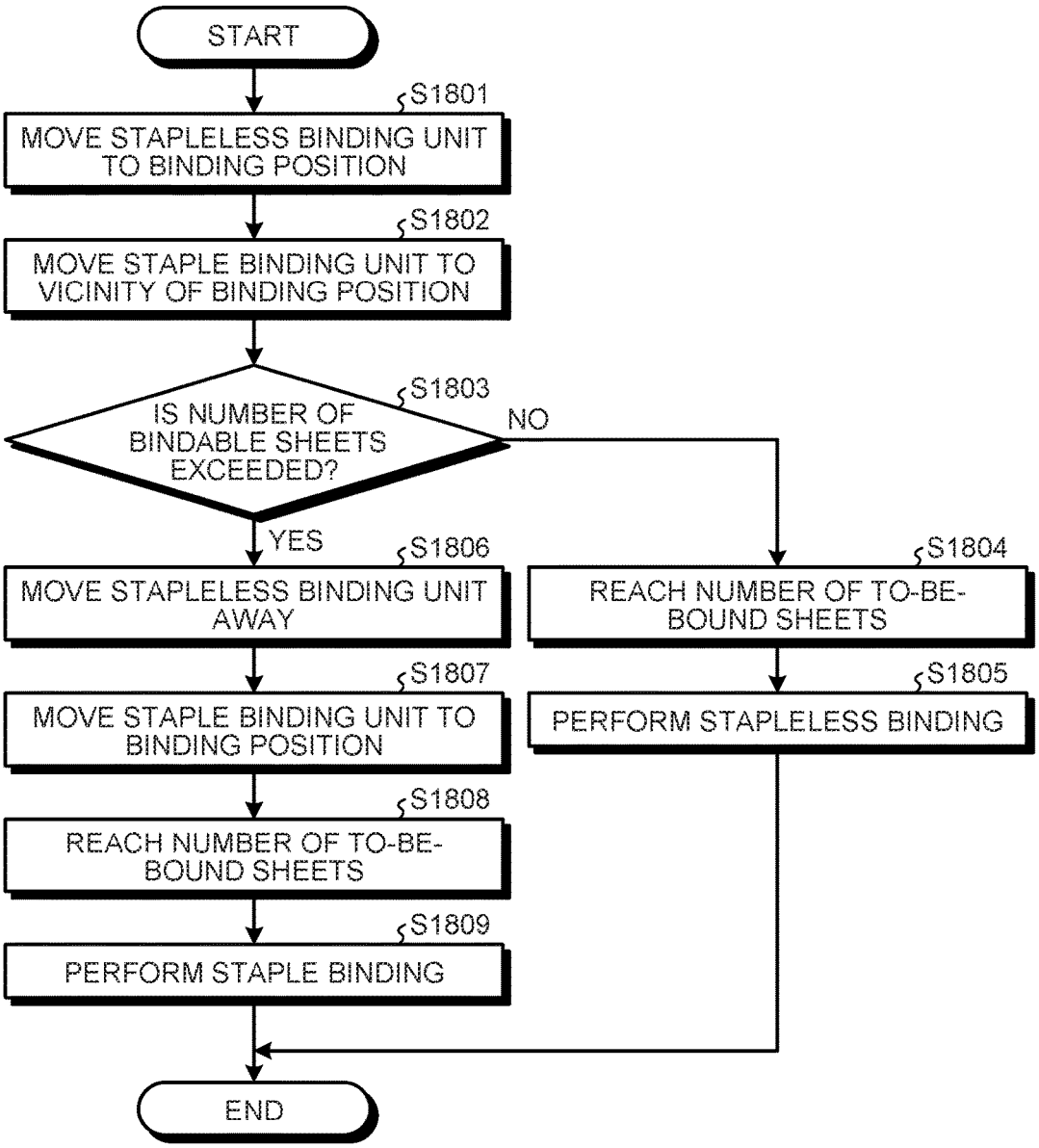
FIG. 18 is a flowchart for explaining a process performed when a stapleless binding execution request is accepted while the binding processing device according to the embodiment of the present invention is in a productivity priority mode.

Next, a process performed when the stapleless binding execution request is accepted while the binding processing device 4 of the first embodiment is in the productivity priority mode will be described with reference to FIG. 18. FIG. 18 is a flowchart for explaining the process performed when the stapleless binding execution request is accepted while the binding processing device 4 of the first embodiment is in the productivity priority mode.

As illustrated in FIG. 18, when the stapleless binding execution request is accepted while the binding processing device 4 of the first embodiment is in the productivity priority mode, the drive control unit 107 first causes the stapleless binding unit 430 and the staple binding unit 420 to move from the home positions to the binding position and the vicinity of the binding position, respectively, and causes them to stand by in these positions (S1801 and S1802). That is, in the first embodiment, the stapleless binding unit 430 functions as a first binding unit and the staple binding unit 420 functions as a second binding unit.

Then, the drive control unit 107 determines whether the specified number of to-be-bound sheets exceeds the number of bindable sheets of the stapleless binding unit 430 (S1803). That is, in the first embodiment, the drive control unit 107 functions as a number-of-sheets determining unit.

When determining that the number of to-be-bound sheets does not exceed the number of bindable sheets in the determination process at S1803 (NO at S1803), the drive control unit 107 determines that it is not necessary to switch to the staple binding. If the number of sheets reaches the number of to-be-bound sheets (S1804), the drive control unit 107 causes the stapleless binding unit 430 to perform the stapleless binding (S1805).

In contrast, when determining that the number of to-be-bound sheets exceeds the number of bindable sheets in the determination process at S1803 (YES at S1803), the drive control unit 107 determines that it is necessary to switch to the staple binding, moves the stapleless binding unit 430 away from the binding position and back to the home position (S1806), and causes the staple binding unit 420 to move from the vicinity of the binding position to the binding position and to stand by in the binding position (S1807).

At this time, if the binding processing device 4 simultaneously moves the stapleless binding unit 430 away from the binding position and back to the home position and moves the staple binding unit 420 from the vicinity of the binding position to the binding position, it is possible to further improve the productivity.

If the number of sheets reaches the number of to-be-bound sheets (S1808), the drive control unit 107 causes the staple binding unit 420 to perform the staple binding (S1809).

Figure 19:
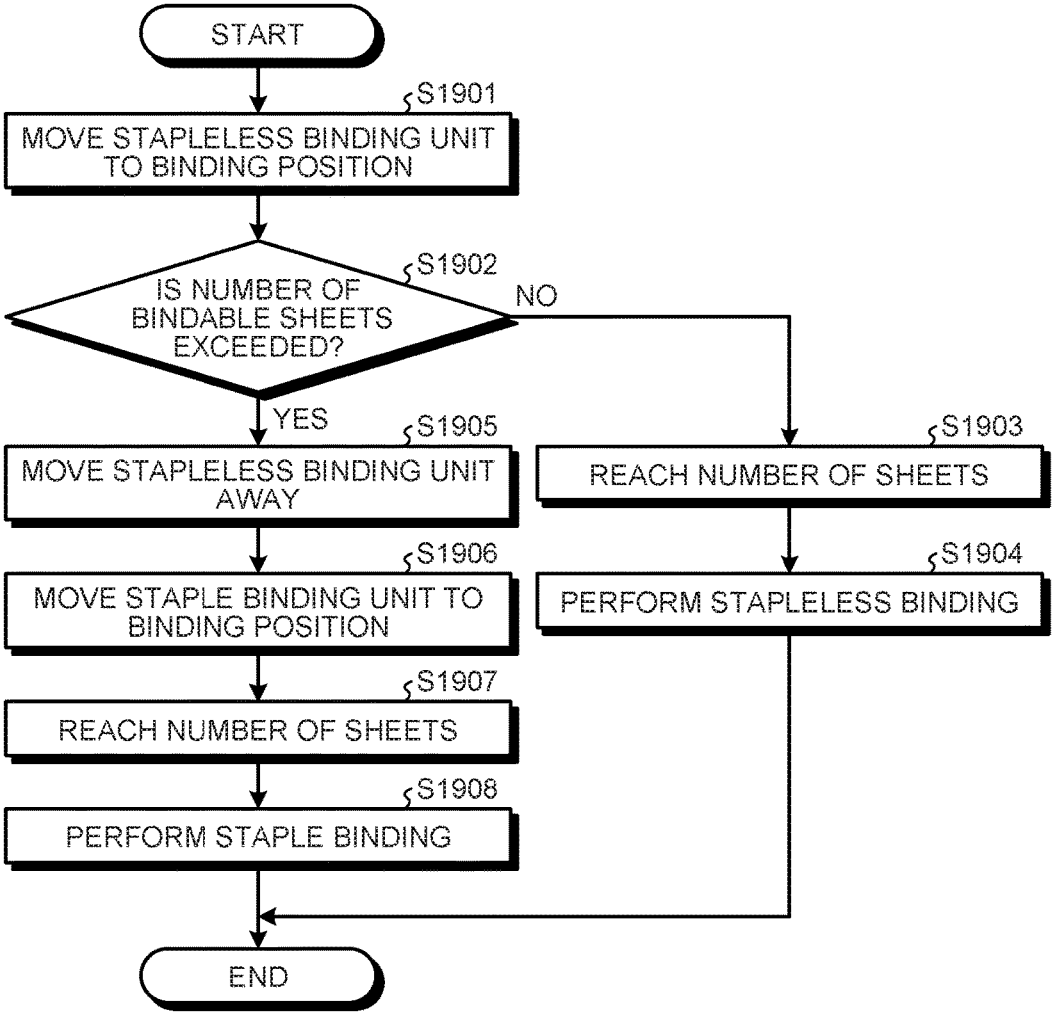
FIG. 19 is a flowchart for explaining a process performed when the stapleless binding execution request is accepted while the binding processing device according to the embodiment of the present invention is in an energy-saving priority mode 1.

Next, a process performed when the stapleless binding execution request is accepted while the binding processing device 4 of the first embodiment is in the energy-saving priority mode 1 will be described with reference to FIG. 19. FIG. 19 is a flowchart for explaining the process performed when the stapleless binding execution request is accepted while the binding processing device 4 of the first embodiment is in the energy-saving priority mode 1.

As illustrated in FIG. 19, when the stapleless binding execution request is accepted while the binding processing device 4 of the first embodiment is in the energy-saving priority mode 1, the drive control unit 107 first causes the stapleless binding unit 430 to move from the home position to the binding position and to stand by in the binding position (S1901).

Then, the drive control unit 107 determines whether the specified number of to-be-bound sheets exceeds the number of bindable sheets of the stapleless binding unit 430 (S1902).

When determining that the number of to-be-bound sheets does not exceed the number of bindable sheets in the determination process at S1902 (NO at S1902), the drive control unit 107 determines that it is not necessary to switch to the staple binding. If the number of sheets reaches the number of to-be-bound sheets (S1903), the drive control unit 107 causes the stapleless binding unit 430 to perform the stapleless binding (S1904).

In contrast, when determining that the number of to-be-bound sheets exceeds the number of bindable sheets in the determination process at S1902 (YES at S1902), the drive control unit 107 determines that it is necessary to switch to the staple binding, moves the stapleless binding unit 430 away from the binding position and back to the home position (S1905), and causes the staple binding unit 420 to move from the home position to the binding position and to stand by in the binding position (S1906).

At this time, if the binding processing device 4 simultaneously moves the stapleless binding unit 430 away from the binding position and back to the home position and moves the staple binding unit 420 from the home position to the binding position, it is possible to further improve the productivity.

If the number of sheets reaches the number of to-be-bound sheets (S1907), the drive control unit 107 causes the staple binding unit 420 to perform the staple binding (S1908).

Figure 20:
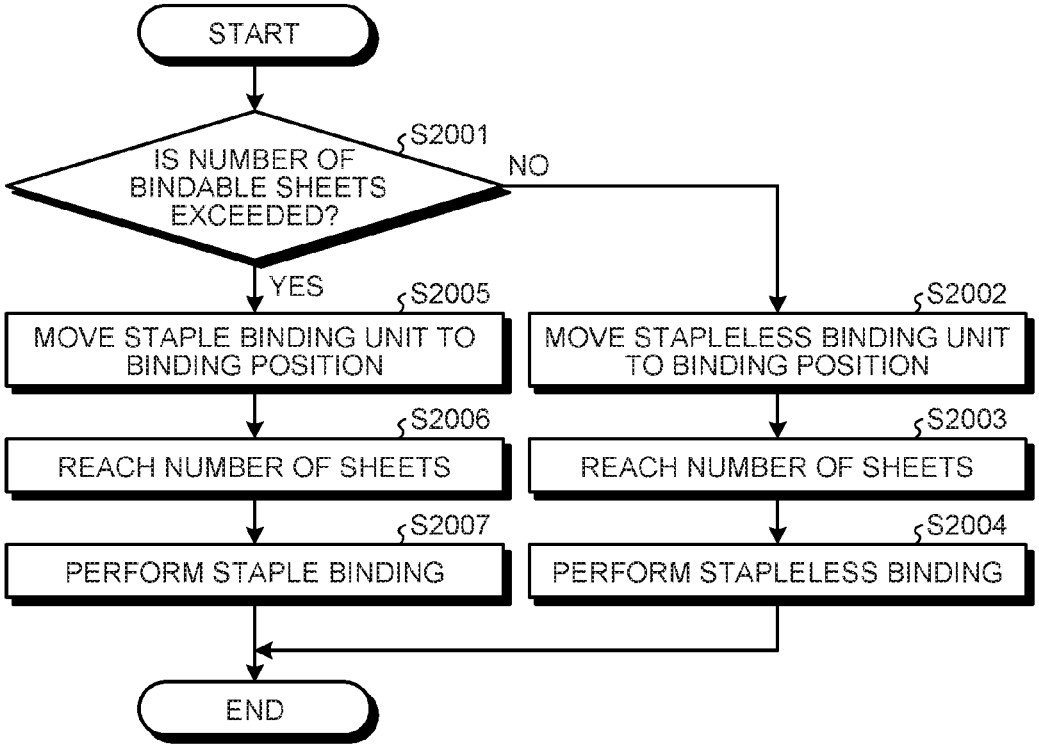
FIG. 20 is a flowchart for explaining a process performed when the stapleless binding execution request is accepted while the binding processing device according to the embodiment of the present invention is in an energy-saving priority mode 2.

Next, a process performed when the stapleless binding execution request is accepted while the binding processing device 4 of the first embodiment is in the energy-saving priority mode 2 will be described with reference to FIG. 20. FIG. 20 is a flowchart for explaining the process performed when the stapleless binding execution request is accepted while the binding processing device 4 of the first embodiment is in the energy-saving priority mode 2.

As illustrated in FIG. 20, when the stapleless binding execution request is accepted while the binding processing device 4 of the first embodiment is in the energy-saving priority mode 2, the drive control unit 107 first determines whether the specified number of to-be-bound sheets exceeds the number of bindable sheets of the stapleless binding unit 430 (S2001).

When determining that the number of to-be-bound sheets does not exceed the number of bindable sheets in the determination process at S2001 (NO at S2001), the drive control unit 107 determines that it is not necessary to switch to the staple binding, and causes the stapleless binding unit 430 to move from the home position to the binding position and to stand by in the binding position (S2002).

If the number of sheets reaches the number of to-be-bound sheets (S2003), the drive control unit 107 causes the stapleless binding unit 430 to perform the stapleless binding (S2004).

In contrast, when determining that the number of to-be-bound sheets exceeds the number of bindable sheets in the determination process at S2001 (YES at S2001), the drive control unit 107 determines that it is necessary to switch to the staple binding, and causes the staple binding unit 420 to move from the home position to the binding position and to stand by in the binding position (S2005).

If the number of sheets reaches the number of to-be-bound sheets (S2006), the drive control unit 107 causes the staple binding unit 420 to perform the staple binding (S2007).

Incidentally, while the binding processing device 4 including only the staple binding unit 420 and the stapleless binding unit 430 is described with reference to FIG. 20, the same applies if the binding processing device 4 includes a plurality of binding units with different numbers of bindable sheets.

Figure 21:
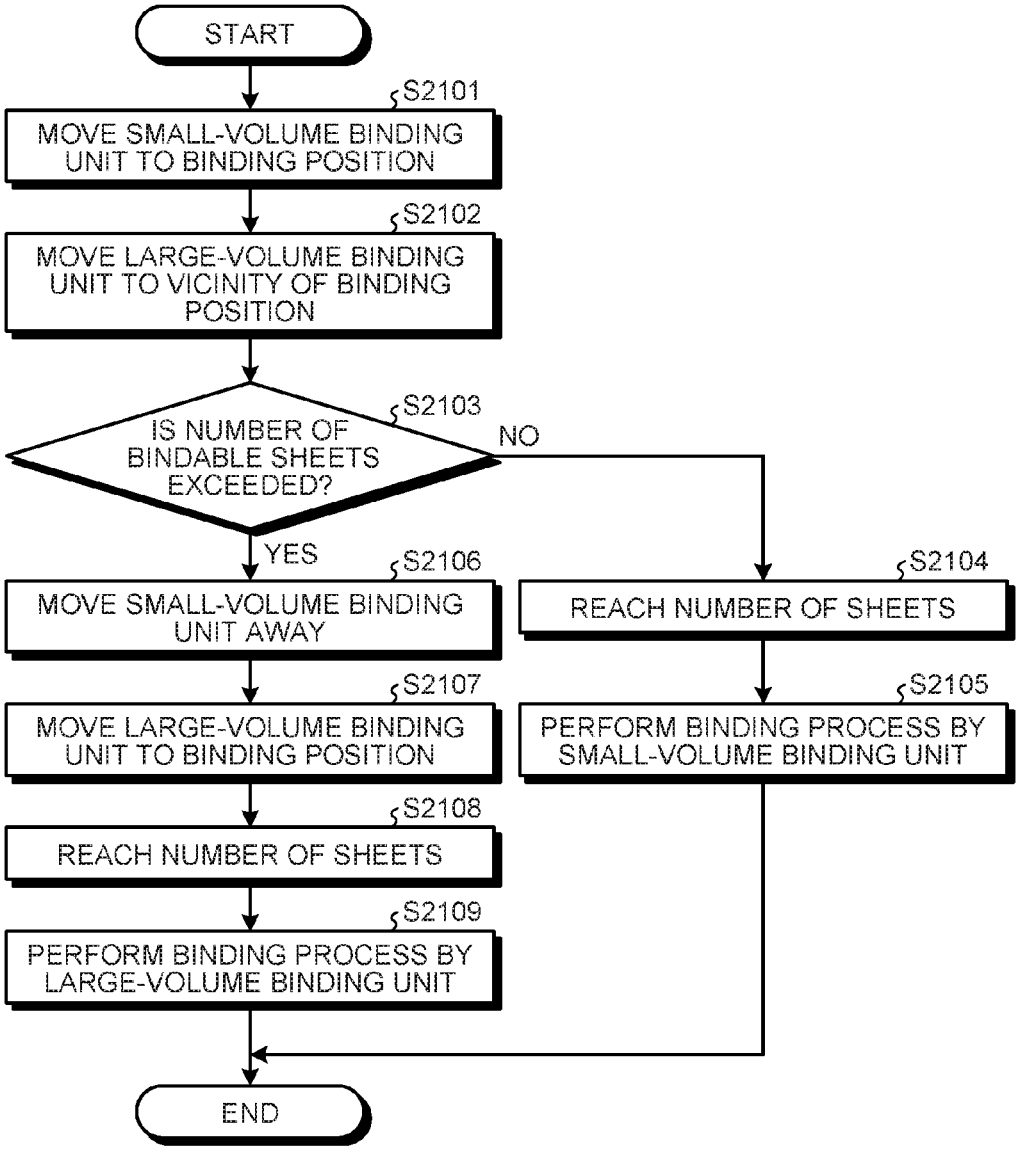
FIG. 21 is a flowchart for explaining a process performed when the stapleless binding execution request is accepted while the binding processing device according to the embodiment of the present invention is in the productivity priority mode.

Therefore, a process performed by the device configured as above will be described with reference to FIG. 21. FIG. 21 is a flowchart for explaining a process performed when a binding process execution request is accepted while the binding processing device 4 of the first embodiment is in the productivity priority mode.

In the following, a binding unit with a greater number of bindable sheets than a binding unit specified in the execution request will be referred to as a large-volume binding unit, and a binding unit with a smaller number of bindable sheets than the large-volume binding unit will be referred to as a small-volume binding unit.

That is, as illustrated in FIG. 21, when a request to execute a binding process by the small-volume binding unit is accepted while the binding processing device 4 of the first embodiment is in the productivity priority mode, the small-volume binding unit and the large-volume binding unit are first caused to move from the home positions to the binding position and the vicinity of the binding position, respectively, and to stand by in these positions (S2101 and S2102).

Then, the drive control unit 107 determines whether the specified number of to-be-bound sheets exceeds the number of bindable sheets of the small-volume binding unit (S2103).

When determining that the number of to-be-bound sheets does not exceed the number of bindable sheets in the determination process at S2103 (NO at S2103), the drive control unit 107 determines that it is not necessary to switch to the large-volume binding unit. If the number of sheets reaches the number of to-be-bound sheets (S2104), the drive control unit 107 causes the small-volume binding unit to perform the stapleless binding (S2105).

In contrast, when determining that the number of to-be-bound sheets exceeds the number of bindable sheets in the determination process at S2103 (YES at S2103), the drive control unit 107 determines that it is necessary to switch to the large-volume binding unit, moves the small-volume binding unit away from the binding position and back to the home position (S2106), and causes the large-volume binding unit to move from the vicinity of the binding position to the binding position and to stand by in the binding position (S2107).

At this time, if the binding processing device 4 simultaneously moves the small-volume binding unit away from the binding position and back to the home position and moves the large-volume binding unit from the vicinity of the binding position to the binding position, it is possible to further improve the productivity.

If the number of sheets reaches the number of to-be-bound sheets (S2108), the drive control unit 107 causes the large-volume binding unit to perform the binding process (S2109).

As described above, even in the binding processing device 4 that includes a plurality of binding units with different numbers of bindable sheets, the moving distance of the staple binding unit 420 at the time of switching from the stapleless binding to the staple binding can be reduced by the same process as illustrated in FIG. 18. Therefore, it is possible to improve the productivity of the binding process. Incidentally, the processes performed when the binding processing device 4 is in the energy-saving priority mode 1 and the energy-saving priority mode 2 are the same as those illustrated in FIG. 19 and FIG. 20, respectively, and therefore, detailed explanation thereof will be omitted.

As described above, the binding processing device 4 of the first embodiment, upon accepting a request to perform a binding process by the small-volume binding unit, moves the small-volume binding unit to the binding position and moves the large-volume binding unit to the vicinity of the binding position before obtaining a determination result on whether it is necessary to switch to the large-volume binding unit.

In the configuration of the binding processing device 4 of the first embodiment as described above, the moving distance of the large-volume binding unit at the time of switching from the small-volume binding unit to the large-volume binding unit is reduced, so that it is possible to improve the productivity of the binding process.

Furthermore, the binding processing device 4 of the first embodiment is configured to move the large-volume binding unit to the binding position after obtaining a determination result indicating that it is necessary to switch to the large-volume binding. In the configuration of the binding processing device 4 of the first embodiment as described above, it is possible to reduce power consumption without reducing the productivity.

Moreover, the binding processing device 4 of the first embodiment is configured to move only a binding unit specified in the execution request to the binding position after obtaining a determination result indicating that it is not necessary to switch to the large-volume binding. In the configuration of the binding processing device 4 of the first embodiment as described above, it is possible to further reduce power consumption as compared to the energy-saving priority mode 1.

Incidentally, in the first embodiment, an explanation has been given of the binding processing device 4 that moves the large-volume binding unit to the vicinity of the binding position upon accepting a request to perform a binding process by the small-volume binding unit.

However, the binding processing device 4 of the first embodiment need not always move the large-volume binding unit to the vicinity of the binding position upon accepting a request to perform a binding process by the small-volume binding unit, but may move the large-volume binding unit to any position closer to the binding position than the home position.

Furthermore, the binding processing device 4 of the first embodiment may be configured to change a standby position of the large-volume binding unit in the vicinity of the binding position depending on a sheet size of a sheet bundle to be bound. In the configuration of the binding processing device 4 of the first embodiment as described above, it is possible to further improve the productivity.

Moreover, the binding processing device 4 of the first embodiment may be configured to change a standby position of the large-volume binding unit in the vicinity of the binding position depending on a position (hereinafter, referred to as an "alignment position") corresponding to a a portion of a sheet where a large curl or a large deflection has occurred.

In the configuration of the binding processing device 4 of the first embodiment as described above, binding faces of the large-volume binding unit provide an effect to prevent the above-described curl or deflection, so that is is possible to prevent misalignment of the ends of sheets in a sheet bundle and improve alignment accuracy of the sheet bundle subjected to the binding process.

In the configuration of the binding processing device 4 of the first embodiment as described above, it may be possible to use a measuring device, such as a sensor, to detect a curl or a deflection that occurs in a sheet, or it may be possible to estimate a curl or a deflection based on sheet information, such as a sheet type, a thickness, a size, or the number of to-be-bound sheets.

Incidentally, if the binding processing device 4 of the first embodiment is configured as described above, the moving distance of the large-volume binding unit to the binding position may be increased. Therefore, the binding processing device 4 of the first embodiment may be configured to operate so as to move the large-volume binding unit to the vicinity of the binding position when a user places priority on the productivity, and operate so as to move the large-volume binding unit to an alignment position when the user places priority on alignment quality.

Second Embodiment

In the first embodiment, an explanation is given of the binding processing device 4 that, upon accepting a request to perform a binding process by the small-volume binding unit, moves the small-volume binding unit to the binding position and moves the large-volume binding unit to the vicinity of the binding position before obtaining a determination result on whether it is necessary to switch to the large-volume binding unit.

In the configuration of the binding processing device 4 of the first embodiment as described above, the moving distance of the large-volume binding unit at the time of switching from the small-volume binding unit to the large-volume binding unit is reduced, so that it is possible to improve the productivity of the binding process.

In contrast, in a second embodiment, an explanation will be given of the binding processing device 4 that, upon accepting a binding process execution request, causes a binding unit having a higher processing speed than a binding unit specified in the execution request to perform the binding process, regardless of the binding unit specified in the execution request. If the binding processing device 4 of the second embodiment is configured as described above, it becomes possible to improve the productivity of the binding process.

In particular, in the configuration of the binding processing device 4 of the second embodiment as described above, if an accepted execution request is a binding process execution request and is an execution request such as an execution request due to interruption or an emergency execution request (hereinafter, referred to as an "interrupt execution request") that requires a short-time process, it is possible to improve convenience by reducing a wait time for a user.

The second embodiment of the present invention will be described in detail below with reference to the drawings. Components denoted by the same reference signs as those of the first embodiment are the same or equivalent components, and detailed explanation thereof will be omitted. In the following, it is assumed that a processing speed of the staple binding unit 420 is higher than a processing speed of the stapleless binding unit 430 in the binding processing device 4 of the second embodiment.

Figure 22:
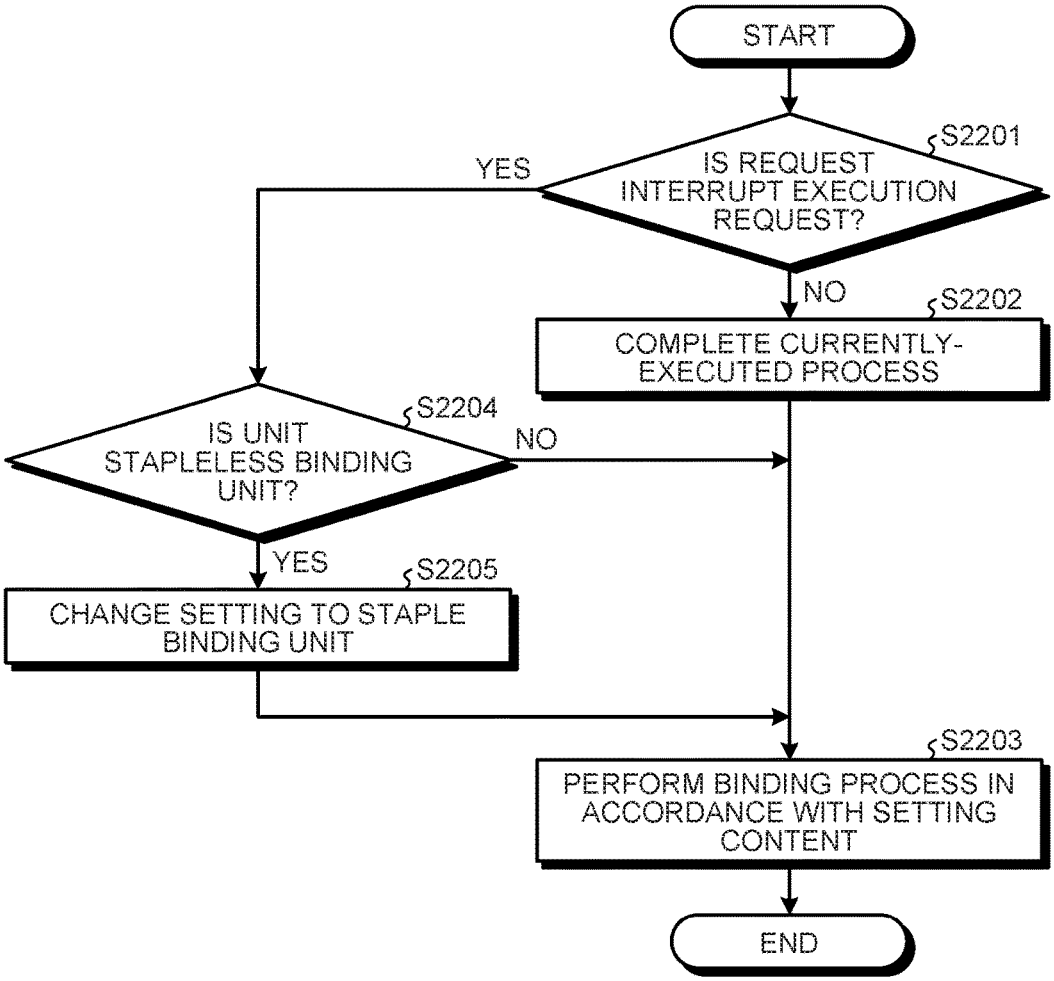
FIG. 22 is a flowchart for explaining a process performed when a binding processing device according to another embodiment of the present invention accepts a binding process execution request.

First, a process performed when the binding processing device 4 of the second embodiment accepts a binding process execution request will be described with reference to FIG. 22. FIG. 22 is a flowchart for explaining the process performed when the binding processing device 4 of the second embodiment accepts the binding process execution request.

As illustrated in FIG. 22, when the binding processing device 4 of the second embodiment accepts a binding process execution request, the drive control unit 107 first determines whether the accepted execution request is an interrupt execution request (S2201).

When determining that the accepted execution request is not the interrupt execution request in the determination process at S2201 (NO at S2201), and when completing a currently-executed process (S2202), the drive control unit 107 performs the binding process in accordance with a setting content specified in the execution request (S2203).

In contrast, when determining that the accepted execution request is the interrupt execution request in the determination process at S2201 (YES at S2201), the drive control unit 107 determines whether a binding unit specified in the execution request is the staple binding unit 420 or the stapleless binding unit 430 (S2204).

When determining that the specified binding unit is not the stapleless binding unit 430 in the determination process at S2204 (NO at S2204), the drive control unit 107 performs the binding process in accordance with the setting content specified in the execution request (S2203).

In contrast, when determining that the specified binding unit is the stapleless binding unit 430 in the determination process at S2204 (YES at S2204), the drive control unit 107 changes a setting to the staple binding unit 420 (S2205), and performs the binding process in accordance with the changed setting content (S2203).

Incidentally, while FIG. 22 illustrates the binding processing device 4 including only the staple binding unit 420 and the stapleless binding unit 430, the same applies if the binding processing device 4 includes a plurality of binding units having different processing speeds.

Figure 23:
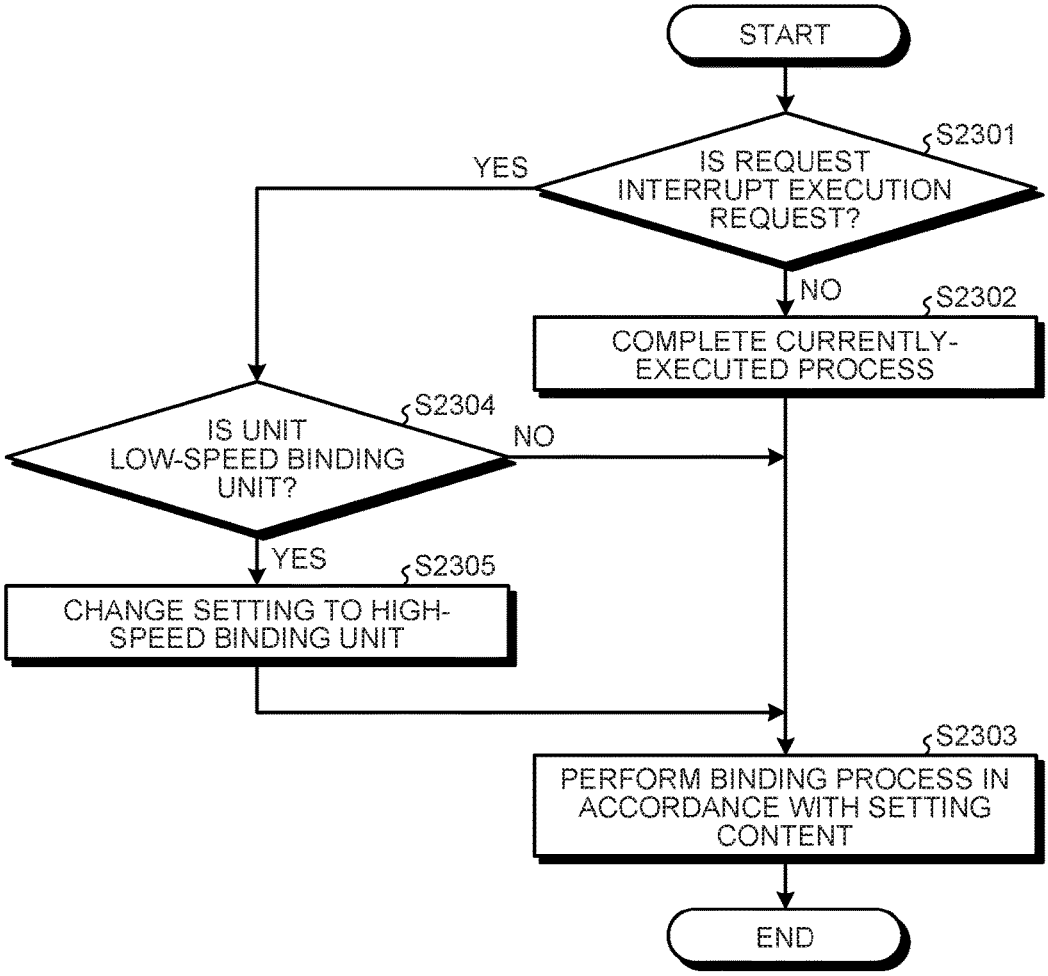
FIG. 23 is a flowchart for explaining a process performed when the binding processing device according to the embodiment of the present invention accepts the binding process execution request.

Therefore, a process performed by the device configured as above will be described with reference to FIG. 23. FIG. 23 is a flowchart for explaining a process performed when the binding processing device 4 of the second embodiment accepts a binding process execution request.

As illustrated in FIG. 23, when the binding processing device 4 of the second embodiment accepts a binding process execution request, the drive control unit 107 first determines whether the accepted execution request is an interrupt execution request (S2301).

When determining that the accepted execution request is not the interrupt execution request in the determination process at S2301 (NO at S2301), and when completing a currently-executed process (S2302), the drive control unit 107 performs the binding process in accordance with a setting content specified in the execution request (S2303).

In contrast, when determining that the accepted execution request is the interrupt execution request in the determination process at S2301 (YES at S2301), the drive control unit 107 determines whether a binding unit specified in the execution request is a binding unit having a lower processing speed (hereinafter, referred to as a "low-speed binding unit") than processing speeds of the other binding units (S2304).

When determining that the specified binding unit is not the low-speed binding unit in the determination process at S2304 (NO at S2304), the drive control unit 107 performs the binding process in accordance with the setting content specified in the execution request (S2303).

In contrast, when determining that the specified binding unit is the low-speed binding unit in the determination process at S2304 (YES at S2304), the drive control unit 107 changes a setting to a binding unit (hereinafter, referred to as a "high-speed binding unit") having a higher processing speed than the processing speed of the binding unit specified in the execution request (S2305), and performs the binding process in accordance with the changed setting content (S2303).

Figure 24:
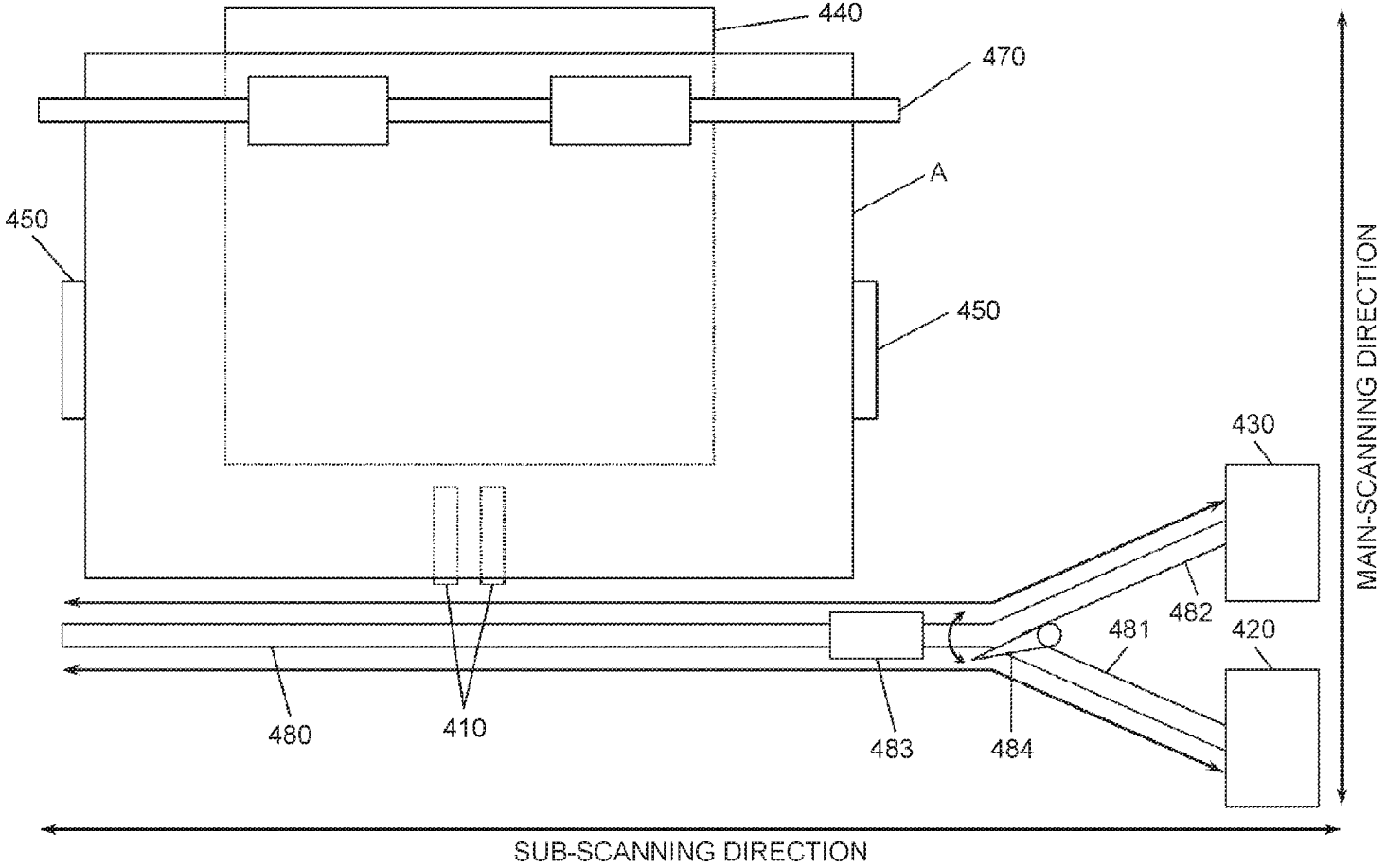
FIG. 24 is a top view illustrating an inside of the binding processing device according to the embodiment of the present invention.

Next, a moving mechanism of the staple binding unit 420 and the stapleless binding unit 430 in the binding processing device 4 of the second embodiment will be described with reference to FIG. 24. FIG. 24 is a top view illustrating an inside of the binding processing device 4 of the second embodiment.

As illustrated in FIG. 24, the binding processing device 4 of the second embodiment includes an interlinked moving unit 483 that moves along a binding position path 480, a staple binding unit path 481, and a stapleless binding unit path 482.

Furthermore, a path switching claw 484 is provided at a bifurcation point from the binding position path 480 to the staple binding unit path 481 and to the stapleless binding unit path 482. By switching the path switching claw 484, the interlinked moving unit 483 can move back and forth between the binding position path 480 and the staple binding unit path 481 or can move back and forth between the binding position path 480 and the stapleless binding unit path 482.

Furthermore, the interlinked moving unit 483 is configured to be interlinked with any of the staple binding unit 420 and the stapleless binding unit 430.

If the interlinked moving unit 483 is interlinked with the staple binding unit 420, the path switching claw 484 closes the stapleless binding unit path 482, so that it becomes possible to move the staple binding unit 420 along the binding position path 480 and the staple binding unit path 481.

If the interlinked moving unit 483 is interlinked with the stapleless binding unit 430, the path switching claw 484 closes the staple binding unit path 481, so that it becomes possible to move the stapleless binding unit 430 along the binding position path 480 and the stapleless binding unit path 482.

In the binding processing device 4 of the second embodiment, the staple binding unit 420 and the stapleless binding unit 430 are moved by the moving mechanism as described above.

As described above, the binding processing device 4 of the second embodiment is configured to, upon accepting a binding process execution request, cause a binding unit having a higher processing speed than a binding unit specified in the execution request to perform the binding process, regardless of the binding unit specified in the execution request. In the configuration of the binding processing device 4 of the second embodiment as described above, it is possible to improve the productivity of the binding process.

In particular, in the configuration of the binding processing device 4 of the second embodiment as described above, if an accepted execution request is an execution request (interrupt execution request) that requires a short-time process, it is possible to improve convenience by reducing a wait time for a user.

Third Embodiment

In the second embodiment, an explanation is given of the binding processing device 4 that, upon accepting a binding process execution request, causes a binding unit having a higher processing speed than a binding unit specified in the execution request to perform the binding process, regardless of the binding unit specified in the execution request.

In the configuration of the binding processing device 4 according to the second embodiment as described above, if an accepted execution request is an execution request that requires a short-time process, it is possible to improve convenience by reducing a wait time for a user.

In contrast, in a third embodiment, an explanation will be given of the binding processing device 4 that, when a binding process execution request is accepted and if a binding unit specified in the execution request is the low-speed binding unit, performs the binding process with a smaller number of bindings than a normal number of bindings. If the configuration of the binding processing device 4 of the third embodiment is configured as described above, it becomes possible to improve the productivity of the binding process.

In particular, in the configuration of the binding processing device 4 of the third embodiment as described above, if an accepted execution request is an execution request (interrupt execution request) that requires a short-time process, it is possible to improve convenience by reducing a wait time for a user.

The third embodiment of the present invention will be described in detail below with reference to the drawings. Components denoted by the same reference signs as those of the first embodiment indicate the same or equivalent components, and detailed explanation thereof will be omitted.

Figure 25:
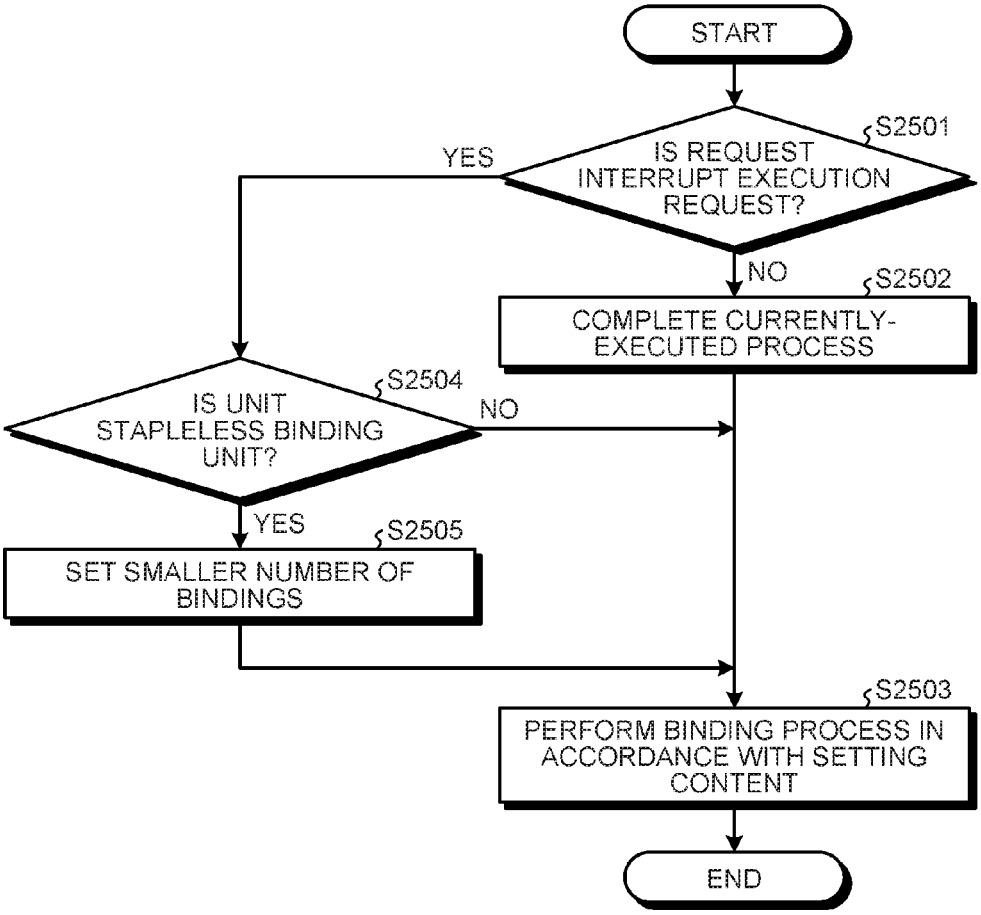
FIG. 25 is a flowchart for explaining a process performed when a binding processing device according to still another embodiment of the present invention accepts a binding process execution request.

First, a process performed when the binding processing device 4 of the third embodiment accepts a binding process execution request will be described with reference to FIG. 25. FIG. 25 is a flowchart for explaining the process performed when the binding processing device 4 of the third embodiment accepts the binding process execution request.

As illustrated in FIG. 25, when the binding processing device 4 of the third embodiment accepts a binding process execution request, the drive control unit 107 first determines whether the accepted execution request is an interrupt execution request (S2501).

When determining that the accepted execution request is not the interrupt execution request in the determination process at S2501 (NO at S2501), and when completing a currently-executed process (S2502), the drive control unit 107 performs the binding process in accordance with a setting content specified in the execution request (S2503).

In contrast, when determining that the accepted execution request is the interrupt execution request in the determination process at S2501 (YES at S2501), the drive control unit 107 determines whether a binding unit specified in the execution request is the staple binding unit 430 or the stapleless binding unit 430 (S2504).

When determining that the specified binding unit is the stapleless binding unit 430 in the determination process at (NO at S2504), the drive control unit 107 performs the binding process in accordance with the setting content specified in the execution request (S2503).

In contrast, when determining that the specified binding unit is the stapleless binding unit 430 in the determination process at S2504 (YES at S2504), the drive control unit 107 changes a setting to a smaller number of bindings than a normal number of bindings (S2505), and performs the binding process in accordance with the changed setting content (S2503).

Incidentally, while FIG. 25 illustrates the binding processing device 4 including only the staple binding unit 420 and the stapleless binding unit 430, the same applies if the binding processing device 4 includes a plurality of binding units having different processing speeds.

Figure 26:
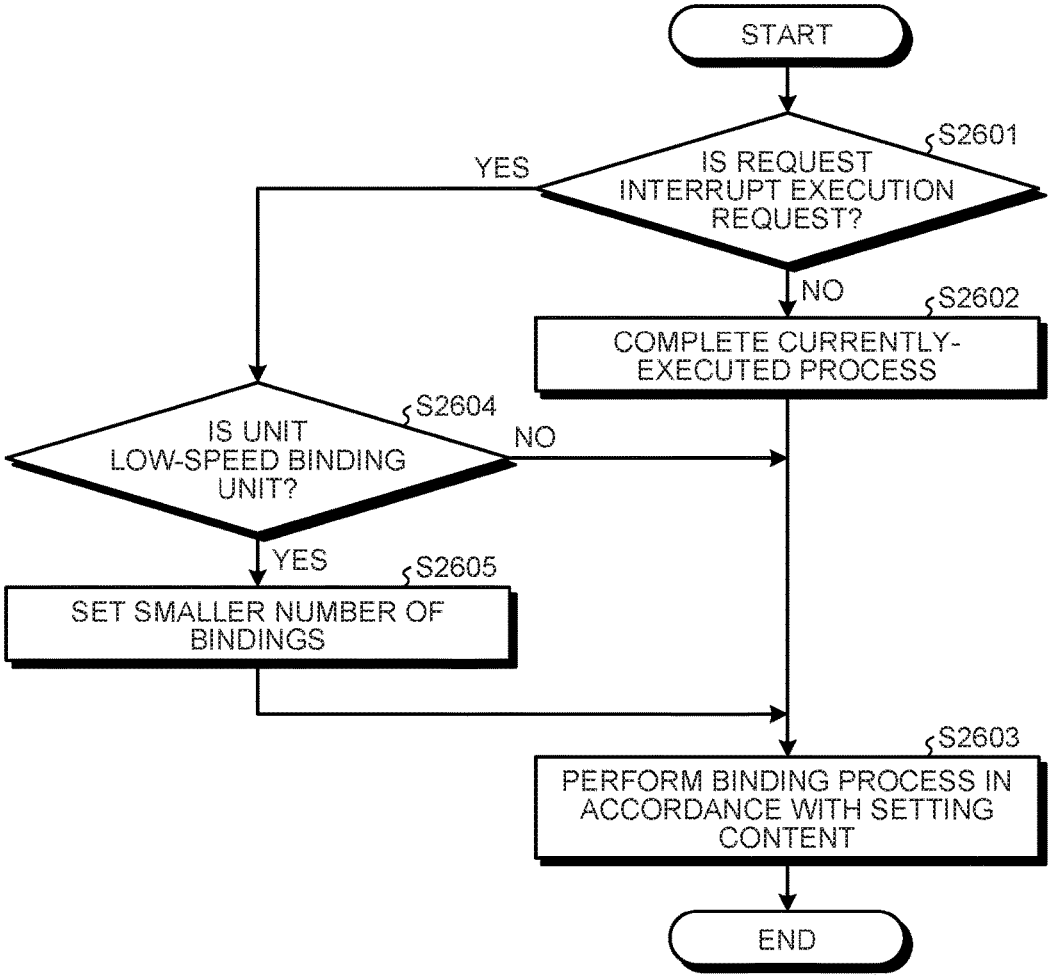
FIG. 26 is a flowchart for explaining a process performed when the binding processing device according to the embodiment of the present invention accepts the binding process execution request.

Therefore, a process performed by the device configured as above will be described with reference to FIG. 26. FIG. 26 is a flowchart for explaining a process performed when the binding processing device 4 of the third embodiment accepts a binding process execution request.

As illustrated in FIG. 26, when the binding processing device 4 of the third embodiment accepts a binding process execution request, the drive control unit 107 first determines whether the accepted execution request is an interrupt execution request (S2601).

When determining that the accepted execution request is not the interrupt execution request in the determination process at S2601 (NO at S2601), and when completing a currently-executed process (S2602), the drive control unit 107 performs the binding process in accordance with a setting content specified in the execution request (S2603).

In contrast, when determining that the accepted execution request is the interrupt execution request in the determination process at S2601 (YES at S2601), the drive control unit 107 determines whether a binding unit specified in the execution request is the low-speed binding unit (S2604).

When determining that the specified binding unit is not the low-speed binding unit in the determination process at S2604 (NO at S2604), the drive control unit 107 performs the binding process in accordance with the setting content specified in the execution request (S2603).

In contrast, when determining that the specified binding unit is the low-speed binding unit in the determination process at S2604 (YES at S2604), the drive control unit 107 changes a setting to a smaller number of bindings than a normal number of bindings (S2605), and performs the binding process in accordance with the changed setting content (S2603).

As described above, the binding processing device 4 of the third embodiment is configured to, when a binding process execution request is accepted and if a binding unit specified in the execution request is the low-speed binding unit, perform the binding process with a smaller number of bindings than a normal number of bindings. In the configuration of the binding processing device 4 of the third embodiment as described above, it is possible to improve the productivity of the binding process.

In particular, in the configuration of the binding processing device 4 of the third embodiment as described above, if an accepted execution request is an execution request (interrupt execution request) that requires a short-time process, it is possible to improve convenience by reducing a wait time for a user.

Incidentally, in the third embodiment, the binding process is performed with a smaller number of bindings than the normal number of bindings when the low-speed binding unit is specified. However, it may be possible to perform the binding process with a smaller number of bindings than the normal number of bindings regardless of the specified binding unit. If the binding processing device 4 of the third embodiment is configured as described above, it becomes possible to further improve the productivity of the binding process.

Figure 27:
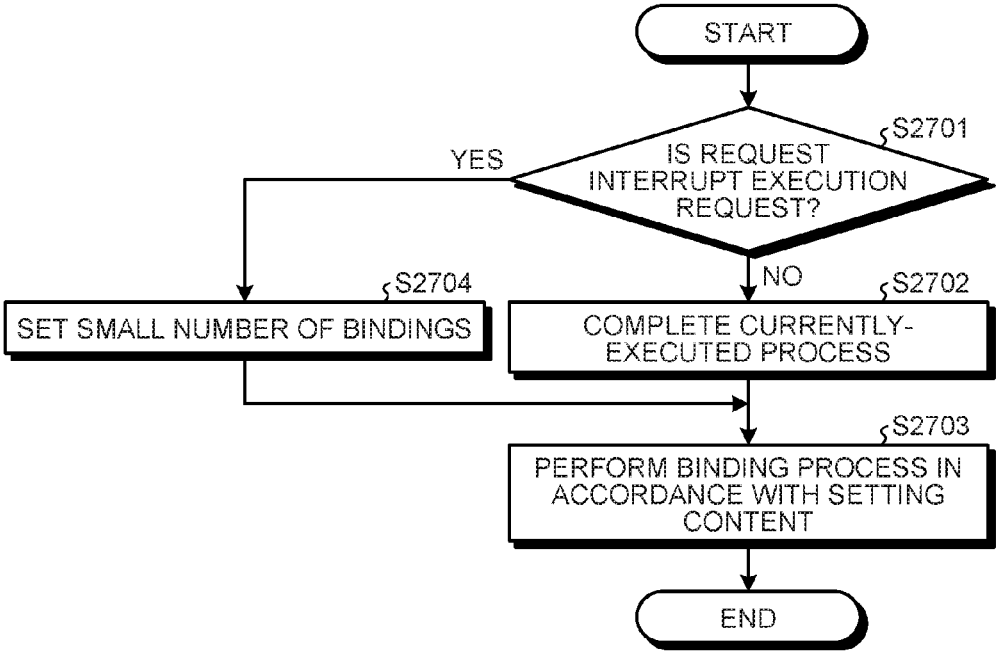
FIG. 27 is a flowchart for explaining a process performed when the binding processing device according to the embodiment of the present invention accepts the binding process execution request.

Therefore, a process performed by the device configured as above will be described with reference to FIG. 27. FIG. 27 is a flowchart for explaining a process performed when the binding processing device 4 of the third embodiment accepts a binding process execution request.

As illustrated in FIG. 27, when the binding processing device 4 of the third embodiment accepts a binding process execution request, the drive control unit 107 determines whether the accepted execution request is an interrupt execution request (S2701).

When determining that the accepted execution request is not the interrupt execution request in the determination process at S2701 (NO at S2701), and when completing a currently-executed process (S2702), the drive control unit 107 performs the binding process in accordance with a setting content specified in the execution request (S2703).

In contrast, when determining that the accepted execution request is the interrupt execution request in the determination process at S2701 (YES at S2701), the drive control unit 107 changes a setting to a smaller number of bindings than a normal number of bindings (S2704), and performs the binding process in accordance with the changed setting content (S2703).

According to the embodiments of the present invention, in a sheet processing apparatus including a plurality of binding units with different numbers of bindable sheets, it is possible to improve productivity of a binding process.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A sheet processing apparatus comprising:

a first binding unit configured to bind a sheet bundle;

a second binding unit with greater number of bindable sheets than number of bindable sheets of the first binding unit; and a number-of-sheets determining unit configured to determine whether number of to-be-bound sheets exceeds the number of bindable sheets of the first binding unit, wherein the first binding unit moves to a binding position, and if the number-of-sheets determining unit determines that the number of to-be-bound sheets exceeds the number of bindable sheets of the first binding unit, the first binding unit moves away from the binding position, and when the number-of-sheets determining unit determines that the number of to-be-bound sheets exceeds the number of bindable sheets of the first binding unit, the second binding unit moves to the binding position.

2. The sheet processing apparatus according to claim 1, wherein the second binding unit moves to a vicinity of the binding position, the vicinity being closer to the binding position than a reference position, and if the number-of-sheets determining unit determines that the number of to-be-bound sheets exceeds the number of bindable sheets of the first binding unit, the second binding unit moves from the vicinity of the binding position to the binding position.

3. The sheet processing apparatus according to claim 2, wherein the second binding unit moves to the vicinity of the binding position before the number-of-sheets determining unit provides a determination result.

4. The sheet processing apparatus according to claim 2, wherein the second binding unit moves to, as the vicinity of the binding position, a position corresponding to a position at which an end of a sheet bundle to be bound is aligned or a position corresponding to a sheet size of the sheet bundle to be bound.

5. The sheet processing apparatus according to claim 2, further comprising a timing setting unit configured to set a timing of moving the second binding unit to the vicinity of the binding position to a time before or after the number-of-sheets determining unit provides a determination result.

6. The sheet processing apparatus according to claim 5, wherein the timing setting unit sets, at a time of default, the timing to a time before the number-of-sheets determining unit provides a determination result.

7. The sheet processing apparatus according to claim 1, wherein a binding unit having a higher processing speed between the first binding unit and the second binding unit performs a binding process.

8. The sheet processing apparatus according to claim 1, wherein a binding unit specified from the first binding unit and the second binding unit performs a binding process with smaller number of bindings than predetermined number of bindings.

9. The sheet processing apparatus according to claim 1, wherein when a short-time process is requested, a binding unit having a higher processing speed between the first binding unit and the second binding unit performs a binding process or a binding unit specified from the first binding unit and the second binding unit performs a binding process with smaller number of bindings than predetermined number of bindings.

10. An image forming system comprising:

an image forming apparatus configured to form an image on a sheet; and a sheet processing apparatus configured to bind a sheet bundle on which images are formed by the image forming apparatus, the sheet processing apparatus comprising:

a first binding unit configured to bind a sheet bundle;

a second binding unit with greater number of bindable sheets than number of bindable sheets of the first binding unit; and a number-of-sheets determining unit configured to determine whether number of to-be-bound sheets exceeds the number of bindable sheets of the first binding unit, wherein the first binding unit moves to a binding position, and if the number-of-sheets determining unit determines that the number of to-be-bound sheets exceeds the number of bindable sheets of the first binding unit, the first binding unit moves away from the binding position, and when the number-of-sheets determining unit determines that the number of to-be-bound sheets exceeds the number of bindable sheets of the first binding unit, the second binding unit moves to the binding position.

* * * * *